US009414639B2

(12) United States Patent
Heathcote

(10) Patent No.: US 9,414,639 B2
(45) Date of Patent: Aug. 16, 2016

(54) DANCE SHOES WITH IMPROVED HEEL AND ARCH SECTIONS

(75) Inventor: Timothy Charles Heathcote, Surrey Hills (AU)

(73) Assignee: MUSE DANCEWEAR PTY LTD, Victoria (AU)

( * ) Notice: Subject to any disclaimer, the term of this patent is extended or adjusted under 35 U.S.C. 154(b) by 907 days.

(21) Appl. No.: 13/637,011

(22) PCT Filed: Mar. 24, 2011

(86) PCT No.: PCT/AU2011/000335
§ 371 (c)(1),
(2), (4) Date: Jan. 15, 2013

(87) PCT Pub. No.: WO2011/116423
PCT Pub. Date: Sep. 29, 2011

(65) Prior Publication Data

US 2013/0104420 A1 May 2, 2013

Related U.S. Application Data

(60) Provisional application No. 61/317,155, filed on Mar. 24, 2010.

(51) Int. Cl.
*A43B 5/12* (2006.01)
*A43B 23/17* (2006.01)
(Continued)

(52) U.S. Cl.
CPC . *A43B 5/12* (2013.01); *A43B 13/41* (2013.01); *A43B 23/17* (2013.01); *A43B 23/227* (2013.01)

(58) Field of Classification Search
CPC .... A43B 13/122; A43B 13/125; A43B 13/41; A43B 23/227; A43B 23/16; A43B 23/17; A43B 7/144; A43B 7/142; A43B 7/143; A43B 21/32
USPC ..... 36/90, 92, 107, 108, 76 R, 28, 69, 36/76 HH, 149, 173, 174
See application file for complete search history.

(56) References Cited

U.S. PATENT DOCUMENTS 2,403,442 A * 7/1946 Klaus ..... A43B 7/142 36/103
2,598,782 A * 6/1952 Gillis ..... A43B 5/00 36/129

(Continued)

FOREIGN PATENT DOCUMENTS

FR 2526668 A1 * 11/1983 ..... A43B 5/08

OTHER PUBLICATIONS

"Mesh ballet slipper design" by Fuzi, available at http://fuzi.net/mesh-canvas/ and http://fuzi.net/mesh-leather-tan/, last accessed Dec. 19, 2012.

*Primary Examiner* — Ted Kavanaugh
(74) *Attorney, Agent, or Firm* — Knobbe, Martens, Olson & Bear, LLP

(57) ABSTRACT

A split-sole dance shoe, comprising:
a thin flexible shoe upper defining an opening to receive a foot;
an outsole region to underlie a sole of the foot and in combination with the upper defining a heel section, an arch section and a forefoot section; and
thin flexible reinforcing structure coupled to the shoe upper and the outsole region and extending from adjacent the opening in an upper part of the heel section around a lower part of the heel section and through the arch section along a longitudinal direction of the shoe, the reinforcing structure broadening from adjacent the opening to substantially cup a lower posterior portion of the calcaneus and then narrowing toward the arch section, the reinforcing structure in the arch section being arranged to closely match flexion of the arch in pointe position without the appearance of bunching of the shoe upper in the arch section.

27 Claims, 19 Drawing Sheets

(51) Int. Cl.
*A43B 13/41* (2006.01)
*A43B 23/22* (2006.01)

(56) References Cited

U.S. PATENT DOCUMENTS

| | | | | | |
|---|---|---|---|---|---|
| 4,179,826 | A * | 12/1979 | Davidson | A43B 21/32 36/129 |
| 4,255,877 | A * | 3/1981 | Bowerman | A43B 23/17 36/128 |
| 4,622,764 | A * | 11/1986 | Boulier | A43B 23/17 36/68 |
| 4,821,430 | A * | 4/1989 | Flemming | A43B 23/17 36/68 |
| RE33,018 | E | 8/1989 | Ostrander | |
| 5,172,494 | A * | 12/1992 | Davidson | A43B 21/32 36/173 |
| 5,956,868 | A | 9/1999 | Stevens et al. | |
| 6,076,284 | A * | 6/2000 | Terlizzi | A43B 13/16 36/102 |
| 6,588,124 | B2 | 7/2003 | Morrone | |
| 6,662,469 | B2 * | 12/2003 | Belley | A43B 13/16 12/142 B |
| 6,895,694 | B2 | 5/2005 | Nye | |
| 7,254,904 | B2 | 8/2007 | Nye | |
| 7,337,558 | B2 | 3/2008 | Terlizzi et al. | |
| 2004/0093761 | A1 | 5/2004 | Nye | |
| 2004/0244226 | A1 * | 12/2004 | Farys | A43B 5/003 36/140 |
| 2005/0198861 | A1 | 9/2005 | Nye | |
| 2006/0196079 | A1 | 9/2006 | Terlizzi et al. | |
| 2007/0107265 | A1 | 5/2007 | Mueller et al. | |
| 2008/0010854 | A1 | 1/2008 | Sokolowski | |
| 2008/0034613 | A1 | 2/2008 | Wilkenfeld et al. | |
| 2008/0086912 | A1 | 4/2008 | Wilkenfeld | |
| 2009/0151200 | A1 | 6/2009 | Niedermeyer et al. | |

* cited by examiner

100

100

222
224
220
226
210
212
208
240
270
200

222
208
220
232
212
208
232
272
200

200
220

400
420
410
440
484
481
484
481

600

694
694
691
610
640
670
691

700
701
702
705
708
710
712
713
715
720
722
724
726
727
728
729
732
734
740
770
772
703

800
801
802
805
808
810
812
813
815
820
822
824
826
827
828
832
834
840
870
872
881
882
803

900
901
902
905
908
910
912
913
915
920
922
924
926
928
929
932
934
940
970
972
903
991
992

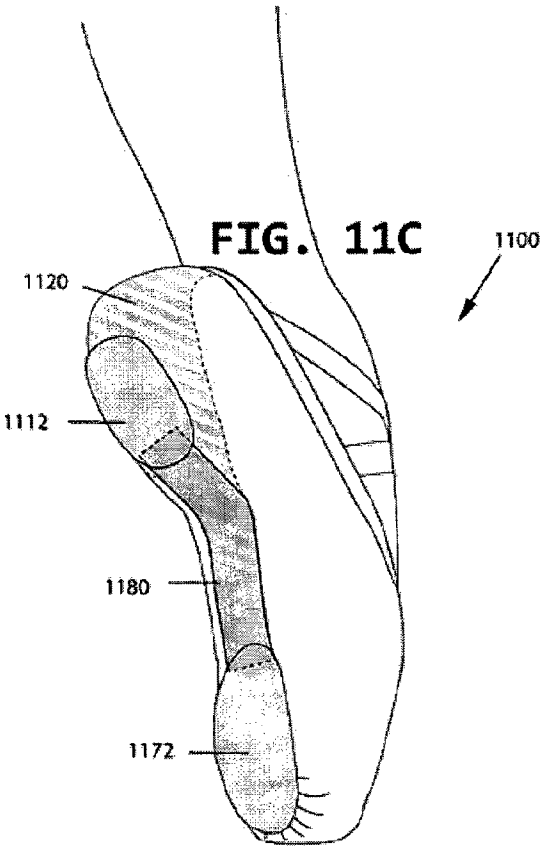
FIG. 11C
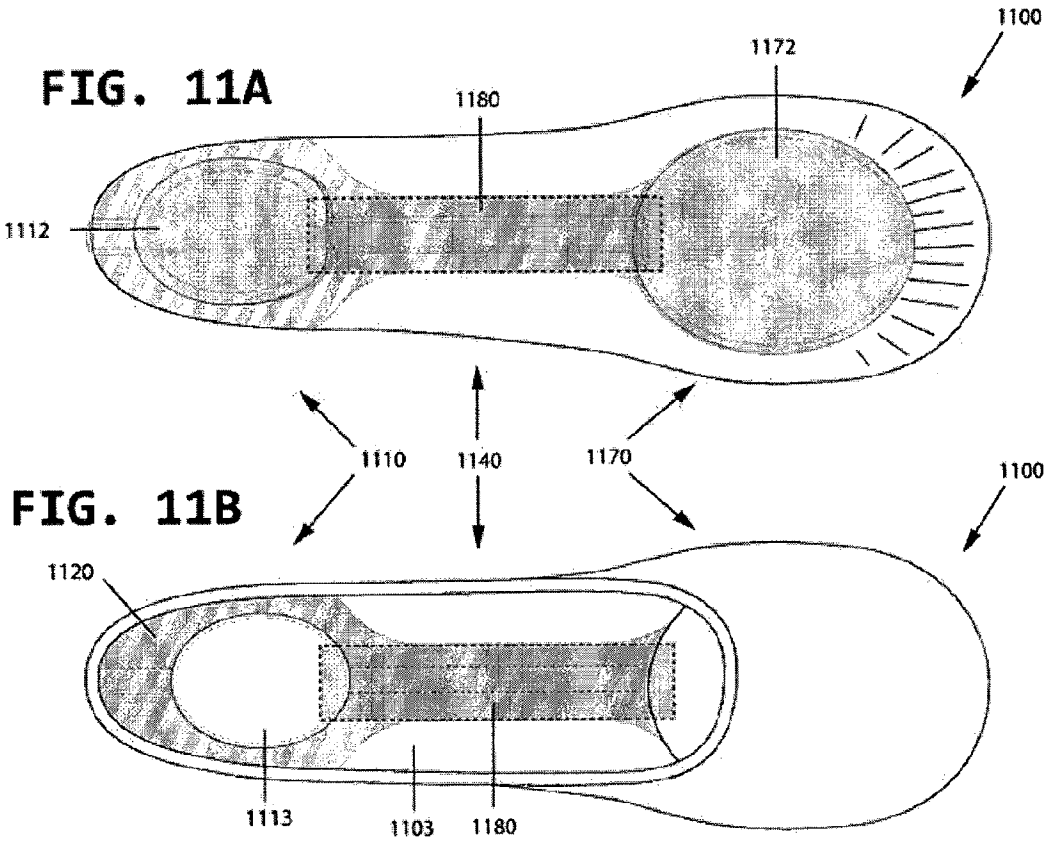
FIG. 11A
FIG. 11B 1270
1240
1210

DANCE SHOES WITH IMPROVED HEEL AND ARCH SECTIONS

CROSS-REFERENCE TO RELATED APPLICATIONS

This application is the U.S. National Stage (Section 371) of PCT/AU2011/000335, filed on Mar. 24, 2011, which claims the benefit under 35 USC 119(e) of U.S. Provisional Patent Application No. 61/317,155, filed on Mar. 24, 2010.

TECHNICAL FIELD

Described embodiments relate to a shoe that is form fitting and/or suitable to undergo a wide range of movement, particularly useful as a dance shoe, yoga shoe, pilates shoe, gymnastic shoe, martial arts shoe, rock climbing shoe or exercise shoe, but not limited to these purposes.

BACKGROUND

As dance is the most extreme example of movement articulation, it will be used as the example discipline throughout this document. Activities requiring precision in movement, particularly dance, require a wide range of general movements including running, jumping, spinning and sliding. The foot and ankle of the dancer will undergo further articulation, including pointing, flexing, turning, twisting, bending and rolling. To enable such a wide range of articulated movement, generally dance footwear is designed to be form fitting and flexible to complement the foot undergoing movement.

Typical footwear consists of two primary elements, an upper and a sole structure. The upper provides a covering for the foot that securely receives and positions the foot with respect to the sole structure. The sole structure is secured to a lower portion of the upper and is generally positioned between the foot and the ground. In addition to reducing friction from the ground, the sole structure, in conjunction with the upper, ideally should provide support and comfort for the bottom of the foot and the arch.

A dance shoe is designed to complement a dancer's wide range of movement and is therefore typically made up of lightweight, flexible materials. As the design is focused on the upper and sole structures being extremely flexible, these structures provide little support for the foot. The shoes permit the user to easily flex the ankle and arch region of the foot but to the detriment of ankle and arch support.

Further to this, a shoe that is allowed to bend and flex will have a side effect of creasing, bunching, puckering and sagging of the upper and outsole materials, creating an unwanted distraction from the clean lines ideally sought. Dance is a strict and regimented art form, any visual distraction from the ideal aesthetic framework will have an adverse effect on the dancers performance in general. In addition, the creasing, bunching, puckering and sagging caused by a flexible shoe can cause a dancer to feel ungainly and unsupported, further affecting their performance.

Some shoes that are flexible have been designed to assist in the flexing of the ankle and arch, reducing resistance when pointing the foot. While this provides ease of movement, it is not ideal when placed in the context of the dancer in training with regards to strengthening, protecting and maintaining their bodies against the rigours of physical activity. Dance is an extremely physical pursuit, with injury levels in line with high level athletes. Subsequently a regimented, disciplined training regime is necessary not only to achieve a high level of ability, but also to keep the body at a peak needed to prevent or minimise injury. The earlier this training begins the more likely the levels of success both artistically and physically. It is not uncommon for dancers to begin their training as young as 3 years old, and beginners older than 10 years are uncommon. Young dancers are taught from an early age to physically strengthen their bodies with exercises covering each and every muscle in the human body, including the feet. To build muscle strength the body needs resistance, so while it is important to encourage flexibility, it is also important to impose levels of resistance to the muscles. During dance training, it is estimated that a dancer might point and flex the foot as many times as once per second and on average once every 5 seconds. When placed in the context of a full dance class, or even a complete dance career spanning many years, the addition of a subtle controlled resistance to each foot flexion motion by way of dance footwear can have a significant longer term effect on muscle strength and stability.

In view of the above, there remains a need for a dance shoe that provides a balance between flexibility and controlled resistance, as well as a shoe that provides a clean unbroken cosmetic line that compliments and enhances a dancer's level of artistry, or that at least provides a useful alternative to prior dance shoes.

SUMMARY

Some embodiments relate to a split-sole dance shoe, comprising:

a thin flexible shoe upper defining an opening to receive a foot;

an outsole region to underlie a sole of the foot and in combination with the upper defining a heel section, an arch section and a forefoot section; and thin flexible reinforcing structure coupled to the shoe upper and the outsole region and extending from adjacent the opening in an upper part of the heel section around a lower part of the heel section and through the arch section along a longitudinal direction of the shoe, the reinforcing structure broadening from adjacent the opening to substantially cup a lower posterior portion of the calcaneus and then narrowing toward the arch section, the reinforcing structure in the arch section being arranged to closely match flexion of the arch in pointe position without the appearance of bunching of the shoe upper in the arch section.

The reinforcing structure of the split-sole dance shoe may extend through the arch section but may not extend through the forefoot section.

Further embodiments relate to a split sole dance shoe, comprising:

a thin flexible shoe upper defining an opening to receive a foot;

an outsole region to underlie a sole of the foot and in combination with the upper defining a heel section, an arch section and a forefoot section; and thin flexible reinforcing structure coupled to the shoe upper and the outsole region and extending from adjacent the opening around the sides and the bottom of the heel section and through the arch section, the flexible reinforcing structure following a longitudinal direction of the shoe and narrowing from a wide cupping coverage of the heel in the heel section as the reinforcing structure transitions between the heel section and the arch section, the reinforcing structure being flat and narrow through the arch section and not extending through the forefoot section.

The reinforcing structure of the split-sole dance shoe may comprise a semi-rigid material. The outsole region may have a heel outsole portion and a forefoot outsole portion, and the semi-rigid material may extend through the arch section and terminate adjacent the forefoot outsole portion. The semi-rigid material may broaden slightly as it transitions from the arch section to the forefoot section and may have a slightly narrowing or substantially constant width as it extends across the arch section.

The split-sole dance shoe may further comprise a backstrap affixed to the shoe upper and may extend along a longitudinal center-line of the shoe from the upper part of the heel section to the forefoot section. The backstrap may coincide with a central longitudinal seam extending through the outsole to the forefoot section.

The split-sole dance shoe may further comprise an elastic panel which may extend from adjacent the opening on one lateral side of the shoe down through the outsole region and around up to adjacent the opening on an opposite lateral side of the shoe. The elastic panel may be free of covering fabric and may interrupt the shoe upper and the outsole. The elastic panel may further allow the shoe to accommodate feet of longer lengths than would be accommodated without the elastic panel.

The elastic panel may be widest where it extends through the outsole region and thinnest adjacent the opening on each lateral side of the shoe, and in some embodiments may be positioned so that it extends through the outsole region at or adjacent a transition from the heel section to the arch section. The elastic panel may be angled toward the upper part of the heel section on each lateral side of the shoe and in alternative embodiments may be positioned so that it extends through the outsole region at or adjacent a transition from the arch section to the forefoot section. The elastic panel may be curved in a rearward sweep as it extends through each lateral side of the shoe.

The reinforcing structure of the split-sole dance shoe may have a thickness of about 2 mm to about 4 mm and may comprise a foam material. The foam material of the split-sole dance shoe may be or comprise ethylene vinyl acetate (EVA) foam, for example. The reinforcing structure may have a density of about 30 $kg/m^3$ to about 120 $kg/m^3$.

The foam material may consist essentially of EVA foam and rubber. The foam material may comprise about 40% to 60% by weight of EVA foam, about 40% to 60% by weight of rubber and 0% to 20% of other material. The rubber may be synthetic rubber. The reinforcing structure may be free of material other than the foam material. Alternatively, the reinforcing structure may further comprise a thin flexible board material.

The reinforcing structure of the split-sole dance shoe may comprise a material selected from the group consisting of: non-woven bonded synthetic fibrous materials; counter materials; fiber boards; sponge rubber; natural rubber; neoprene; styrene-butadiene rubber (SBR); butyl rubber; silicone rubber; nitrile rubber; urethane rubber; polyurethane foam; cork; cellulosic materials; ethylene vinyl acetate (EVA) foam; polyethylene foam; cross-linked polyethylene foam; high density micro-cellular foam; and closed cell polyvinyl chloride foam.

A material of the upper of the split-sole dance shoe may comprise one or more of: leather; polyurethane (PU) leather; canvas; suede; cotton; nylon; Lycra; mesh and spandex.

Further embodiments relate to a full-sole ballet shoe, comprising:

a thin flexible shoe upper defining an opening to receive a foot;

a full outsole coupled to the shoe upper to underlie a sole of the foot and in combination with the upper defining a heel section, an arch section and a forefoot section; and thin flexible reinforcing structure coupled to the shoe upper and the outsole and extending from adjacent the opening in an upper part of the heel section around a lower part of the heel section to the arch section along a longitudinal direction of the shoe, the reinforcing structure broadening from adjacent the opening to substantially cup a lower posterior portion of the calcaneus and then narrowing toward the arch section.

Some embodiments relate to a split-sole dance shoe, comprising:

a thin flexible shoe upper defining an opening to receive a foot;

an outsole region to underlie a sole of the foot and in combination with the upper defining a heel section, an arch section and a forefoot section, first thin flexible reinforcing structure extending within the shoe across the arch section and forming part of an insert attached to the inside of the outsole;

second thin flexible reinforcing structure attached to the heel section and extending from adjacent the opening, around the sides and bottom of the heel section and toward the arch section.

The second thin flexible reinforcing structure may not extend through the arch section.

The first and second thin flexible reinforcing structures may consist of a foam material. The foam material may comprise EVA foam. The foam material may comprise a blen of EVA foam and rubber.

The split-sole dance shoe may further comprise a heel counter attached in the heel section, wherein the shoe upper and at least part of the outsole may comprise suede and wherein the second thin flexible reinforcing structure may be attached to the suede and the heel counter.

The insert may comprise a heel portion to underlie the heel and a forefoot portion to underlie the forefoot, with the first thin flexible reinforcing structure coupled to the heel portion at one end of the first thin flexible reinforcing structure and to the forefoot portion at an opposite end. These embodiments may apply to a jazz shoe, to a ballet shoe with an elastic panel intermediate the arch section and the heel section or to a ballet shoe having an extra board material extending through the arch section, for example.

In the following description, some specific embodiments are directed to a ballet shoe, while other embodiments encompass jazz shoes, tap shoes, dance sneakers and modern dance shoes.

BRIEF DESCRIPTION OF THE DRAWINGS

FIG. 11A is a bottom view of a split sole ballet shoe according to further embodiments;

FIG. 11B is a top view of the split sole ballet shoe of FIG. 11A;

FIG. 11C is a rear perspective view of the split sole ballet shoe of FIG. 11A, shown in pointe position;

DETAILED DESCRIPTION

Figure 1A:
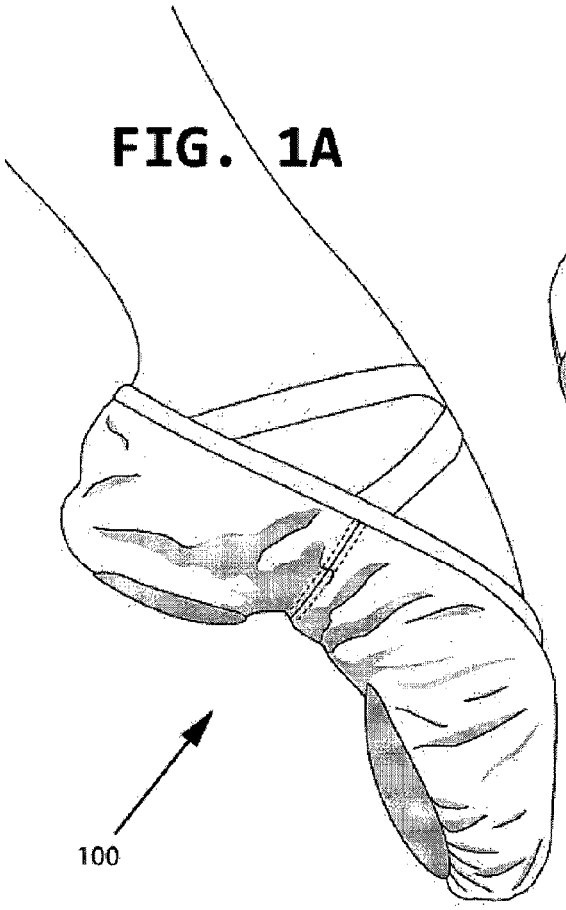
FIG. 1A shows a standard split sole ballet slipper in pointe position from side view.

In the description and drawings, like reference numerals and different reference numerals having the same last two digits are used to indicate like or analogous functions and/or features as between the embodiments. For example, the last two digits "10" are consistently used to refer to a heel section in each of the embodiments.

Described embodiments relate to a shoe that is form fitting and/or suitable to undergo a wide range of movement, particularly useful as a dance shoe, yoga shoe, pilates shoe, gymnastic shoe, martial arts shoe, rock climbing shoe or exercise shoe, but not limited to these purposes. As dance is the most extreme example of movement articulation, dance is used as the example movement discipline throughout this document.

Described embodiments generally relate to shoes or slippers suitable for use while dancing and particular illustrated embodiments are suitable for use as ballet or jazz dancing shoes. Features and functions of the described embodiments, and in particular the described flexible reinforcing structures, are also applicable to dance sneakers, tap shoes, modern dance shoes and other exercise-specific shoes. Described embodiments may improve the aesthetic appearance of a shoe undergoing movement due to foot and ankle flexion, may provide increased support for the foot undergoing movement and may offer beneficial or therapeutic resistance to the person performing the activity.

The embodiments described below depart from prior approaches by introducing a semi-rigid but still flexible reinforcing structure to heel and arch components of split sole shoes. When the foot is articulated, described embodiments allow a full range of motion required by a dancer and introduce a semi-rigid reinforcing material that can move with the foot, and ensure that the soft materials that make up the shoe remain smooth, and are displaced evenly, thereby eliminating or substantially reducing the appearance of any creasing, bunching, puckering and/or sagging of materials. This flexible reinforcing structure results in an unbroken formation along the line of the foot when the foot is in motion. In some cases, depending on the type of dance shoe in question, embodiments may also involve stretch panels that perform the function of reducing the visual effect of relative longitudinal movement between a foot as it flexes and the shoe materials to assist the appearance of a smooth unbroken line. This is particularly noticeable in thin, light dance shoes, such as jazz shoes and ballet shoes.

Described embodiments also increase the levels of support for the foot and ankle by applying the semi-rigid material to areas of the shoe that are expected to support the foot, like the heel, arch and outsole areas. This creates a flexible connection between the heel of the shoe, the outsoles of the shoe and the arch of the shoe, offering more structure and body to the shoe and subsequently more support. This same semi-rigid material, by way of the thin flexible connection between the heel, outsoles and arch of the shoe, also offers controlled resistance to the muscles of the foot when performing a flex or point motion. This controlled resistance encourages increased muscle strength over time. The application of the flexible reinforcing structure around the heel and arch sections may also improve the comfort level of dance shoes, which can increase the dancer's confidence or sense of ease during movement.

Described embodiments of a dance shoe comprise an outsole region coupled to, or at least partially integrally formed with, a shoe upper, including a toe or forefoot region, a heel region, a foot opening at the heel region and an arch region extending between the forefoot region and the heel region. The outsole region includes ground-engaging surfaces of the shoe, for example such as heel and forefoot outsole portions or a full outsole piece. The shoe upper may be made of a suitable flexible, durable material, for example such as leather, polyurethane (PU) leather, canvas, suede, cotton, nylon, Lycra, spandex and mesh materials (for example, polyester mesh, nylon mesh, spandex mesh, cotton mesh). The shoe can contain a single outsole combination, commonly referred to as a "full sole", or multiple outsole constructions, commonly referred to as a "split sole". Outsole combinations can be made of materials such as suede, leather, PU, thermoplastic rubber (TPR), vulcanised rubber, EVA foam or other shock absorbing materials. Outsoles can be made up of combinations of these materials in either single or multiple layers.

Embodiments contain at least one piece of semi-rigid material that has qualities that provide a flexible reinforcing structure to an otherwise soft and flexible shoe. The shoe materials must also be able to bend and flex with the motion of the foot, striking a balance between structure and flexibility. One material example that can achieve this, that is contained in some embodiments, is Ethylene Vinyl Acetate (EVA) foam. EVA foam is available in a wide range of grades, differing in thickness and density. To obtain the desired effect, a balance between these variables is needed.

To maintain a sleek finish with minimal disruption inside the shoe, a thickness of the semi-rigid material ranging from about 2 mm to about 4 mm is considered to be suitable. The thickness required is determined by the type of shoe being constructed. For example, a ballet shoe with a delicate soft construction may require thin 2 mm foam. As the shoe design becomes naturally more structured, thicker EVA foam may be required. For example, a jazz shoe may use 3 mm EVA foam and a tap shoe or dance sneaker may use 4 mm EVA foam.

To obtain the desired effect, a certain density or range of densities of the semi-rigid material is required to strike the optimal balance between flexibility, support and comfort. At the EVA foam thicknesses specified above (2 mm-4 mm), a density of around 30 kg/m$^3$ to around 60 kg/m$^3$ is considered to be suitable to give the desired effect. Some variation of thicknesses and density of EVA foams can also result in acceptable results. For example, the density can rise into the 75 to 105 kg/m$^3$ range or even up to 120 kg/m$^3$, if the EVA foam is kept thin (e.g. 2-3 mm). In some embodiments, the foam material may comprise EVA blended or otherwise combined with a rubber material, such as a synthetic rubber material.

Other material examples that can achieve acceptable results as a flexible reinforcing material include other foam variants, for example such as (but without limitation) Polyurethane Foam, Polyethylene Foam, Cross-Linked Polyethylene Foam, High Density Micro Cellular Foam and closed cell PVC Foam. Such materials in different thicknesses and grades of density provide a wide range of options for implementing described embodiments. Foam has excellent buoyancy properties and provides a good balance between structure, flexibility and resistance. Foam also offers cushioning properties, further enhancing the comfort levels for the wearer. Other flexible reinforcing materials that can be employed in embodiments include, but are not limited to: felts, non-woven bonded synthetic fibres, counter materials and fibre boards, Sponge Rubber, Rubber (Natural, Neoprene, SBR, Butyl, nitrite or Buna N, Silicone, and Urethane), Cork, Flocked Fabrics and Paper (or other cellulose-based materials). Also upper materials such as leather, polyurethane (PU) leather, canvas, suede, cotton, nylon, Lycra, spandex and mesh are suitable, particularly when the semi-rigid material structure is located on the outside of the shoe.

In some embodiments, the semi-rigid material is attached to the shoe upper using a stitch and/or adhesive. The stitch or adhesive attaches the semi-rigid material starting at the top of the heel section, extending down and forward along a line through the side or back quarter of the shoe and extending into and through the arch section. The stitch and/or adhesive connect the semi-rigid material to both the upper and its linings or just its linings or upper. The heel back strap follows a longitudinal direction, such as along a centre-line of the shoe from the top of the heel section and around into the arch section. The semi-rigid material continues through the arch and joins the front outsole, completing the connection. The reinforcing structure of the semi-rigid material connects the heel section, rear outsole and arch sections in a semi-rigid, but flexible support structure.

In such embodiments, when the foot is in motion, bending and flexing, excess shoe material arising from foot flexion will travel to the ends of the shoe forward and backward, leaving a clean line under the arch and around the heel. The presence of a semi-rigid material encasing the heel and extending through the arch, all joined as one piece, increases support levels for the foot and ankle, and offers controlled resistance.

In some embodiments, the semi-rigid material extends around the heel and through the arch and ends at a flexible front stretch panel positioned around where the arch transitions into the forefoot. A back strap material is also attached from the heel section through into the arch section. The stretch panel serves to dissipate bunching or sagging of the material when the foot is in motion, bending and flexing. Rather than the foot flexion causing the shoe material to travel forwards and backwards to the heel and toe sections as mentioned above, the travel of the material is absorbed through the stretch panel, leaving a clean line under the arch and around the heel. The stretch panel also acts as a size leeway, allowing the wearer a more custom fit.

In some embodiments, the semi-rigid material is attached to the shoe upper using a stitch and/or adhesive, starting around the forefoot section of the shoe and extending along a line through the arch section. This stitch and/or adhesive connect the semi-rigid material to both the upper and its linings or just its linings or upper. A back strap material is also attached through into the arch section. This connects the front outsole section and arch section in a semi-rigid, but flexible support structure. The material continues posteriorly through the arch and ends at a flexible rear stretch panel positioned around where the arch transitions into the heel. The stretch panel serves to mitigate against bunching or sagging of the material when the foot is in motion, bending and flexing. Rather than the foot flexion causing the shoe material to seem to travel forwards and backwards to the heel and toe sections as mentioned above, the travel of the shoe material is absorbed through the stretch panel, leaving a clean line under the arch. The stretch panel also acts as a size leeway, allowing the wearer a more custom fit. The semi-rigid material encasing the heel is still present in such embodiments, but is separated from the front semi-rigid material by the back stretch panel. The rear section of semi-rigid material serves to increase support for the heel and ankle and ensure a clean smooth material line around the heel. These areas will increase support levels for the foot and ankle, and offer controlled resistance.

In summary, embodiments may employ the semi-rigid material as a reinforcing structure in one of three ways:

1. The semi-rigid material starting from the heel section and extending uninterrupted until it terminates at the front outsole (forefoot) section;
2. The semi-rigid material starting from the heel section and extending until it reaches a forward located stretch panel; and
3. A divided or interrupted semi-rigid material having a portion of semi-rigid material starting from the front outsole (forefoot) section and extending rearward until it reaches a rear located stretch panel, with a further portion of semi-rigid material at least partially cupping the heel (calcaneus) in the heel section.

Figure 1B:
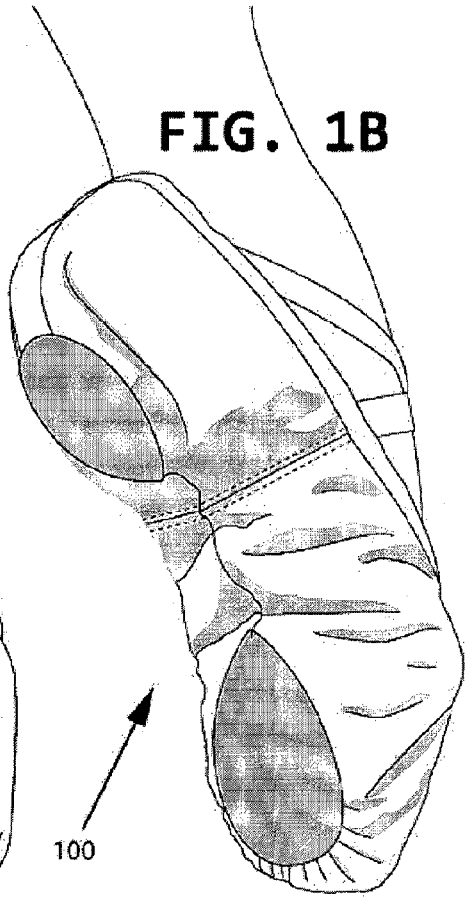
FIG. 1B shows a standard split sole ballet slipper in pointe position from ¾ back view.

FIG. 1A and FIG. 1B show a standard split sole canvas ballet slipper 100 in pointe position. When the foot is in pointe position (contracted) it is up to 20% shorter (in a straight line from heel to toe) than when standing flat in a neutral position. The muscles contract and the metatarsals compact, creating an overall shortening of the foot. For the canvas ballet slipper, the canvas material contracts with the foot and subsequently wrinkles, buckles and sags, creating an undesirable look.

Figures 2A, 2B, 2C:
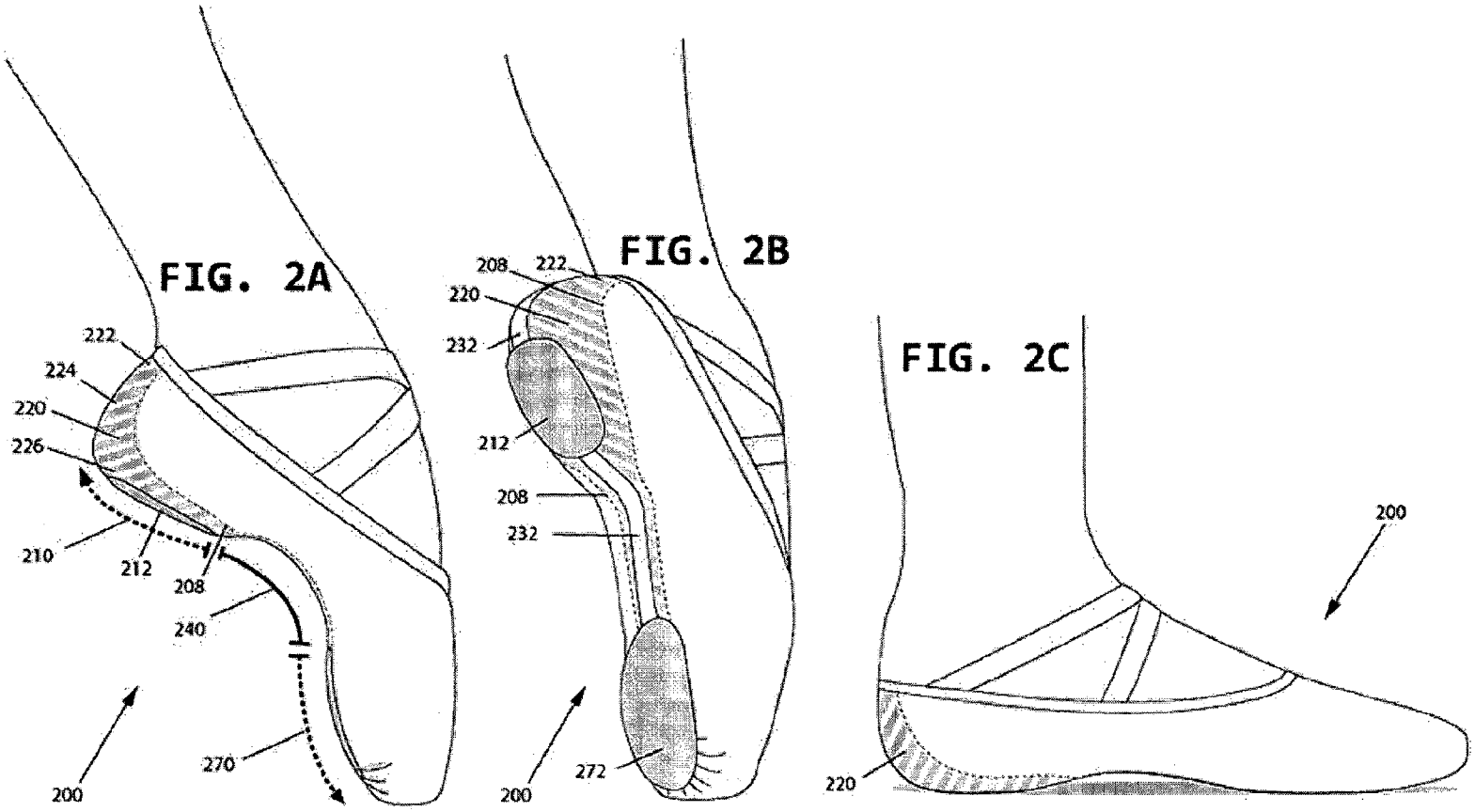
FIG. 2A shows a split sole ballet slipper of some embodiments in pointe position from side view.
FIG. 2B shows the split sole ballet slipper of FIG. 2A in pointe position from ¾ back view.
FIG. 2C shows the split sole ballet shoe of FIG. 2A with the dancer standing flat.

FIGS. 2A, 2B and FIG. 2C illustrate a ballet shoe in the form of a slipper 200 according to some embodiments. Slipper 200 has a heel section 210, an arch section 240 and a forefoot section 270. The shoe shown in FIGS. 2A and 2B is a split sole ballet slipper in pointe position with a semi-rigid material 220 applied as a reinforcing structure through the heel and arch sections 210, 240. In the illustrated embodiments, the semi-rigid material 220 is stitched inside the shoe 200, progressing from an upper heel portion 222 of the heel section 210 and travelling down through a mid-heel portion 224, around a lower heel portion 226 through the heel outsole portion 212 and along a longitudinal direction, such as a centre-line, of the arch section 240. The heel back strap 232 also continues into the arch section 240 underneath the heel outsole portion 212. These components combine to give the shoe more body with a smooth finish, and prevent the canvas from wrinkling. As in FIGS. 1A and 1B, the shoe material may move relative to the foot when foot flexion occurs and this is apparent from the creation of a small void of space between the foot and the ends of the shoe in the heel section 210 and toe area of the forefoot section 270 when the foot flexes to pointe position.

FIG. 2C shows the split sole ballet shoe 200 with the dancer standing flat. In this position, the foot is at its longest and standard dance shoes fit the foot cleanly.

FIGS. 2A and 2B show the split sole ballet shoe 200 in pointe position. In this position the foot muscles are contracted. The bones have compressed and the foot is up to 20% shorter. This diagram shows how the semi-rigid material 220 and the stitch 208 connecting it to the body of the shoe 200, extend from the heel section 210 through the rear outsole 212 and into the arch section 240, connecting to the forefoot outsole portion 272 of forefoot section 270. A "cup" shape formed by the reinforcing structure in the heel section 210 and the flexible arch section 240 maintain a relatively rigid smooth clean line, with minimal wrinkling, bunching or puckering of fabric.

Figure 2D:
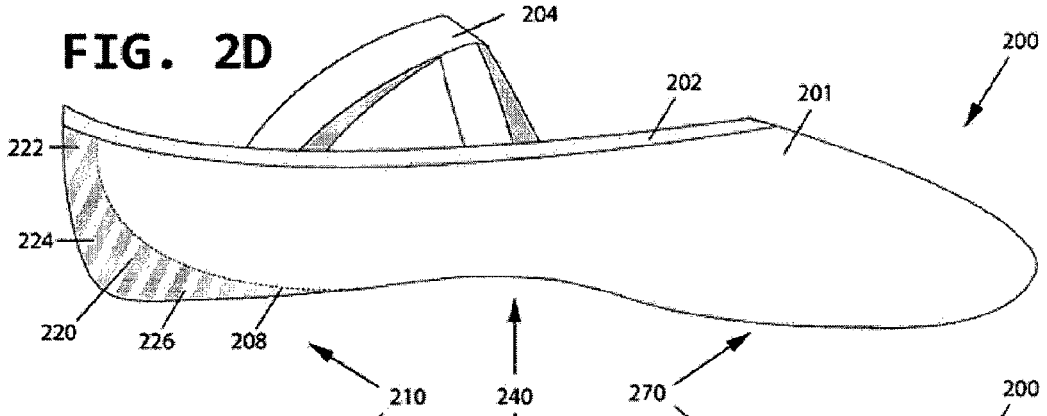
FIG. 2D is a side view of a split sole ballet slipper of FIG. 2A with a semi-rigid material starting at the rear heel and finishing uninterrupted at the front outsole.
Figure 2E:
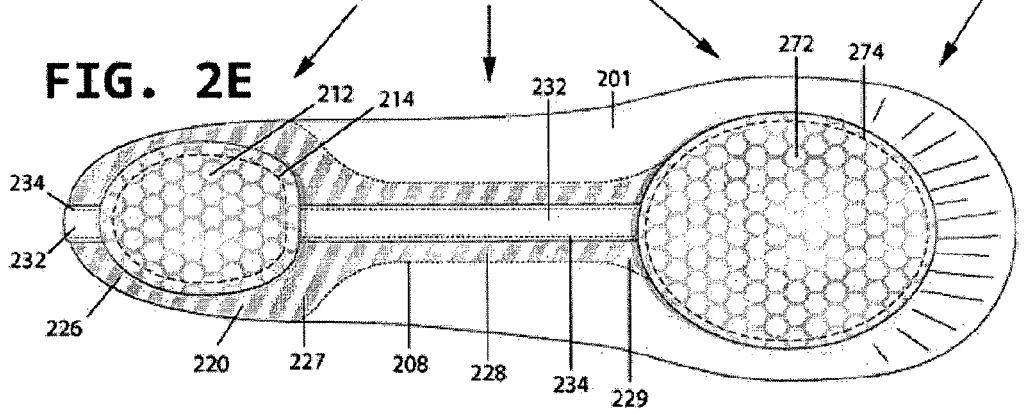
FIG. 2E shows a bottom view of the split sole ballet slipper of FIG. 2A.
Figure 2F:
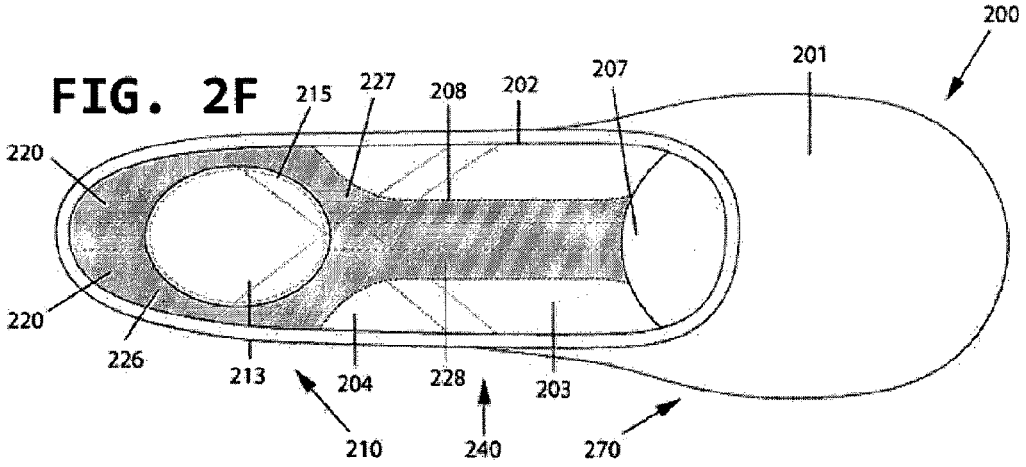
FIG. 2F shows a top view of the split sole ballet slipper of FIG. 2A.

FIGS. 2D, 2E and 2F further illustrate the split sole ballet slipper 200 shown in FIGS. 2A to 2C, showing a side view, bottom view and top view, respectively. The presence of the semi-rigid material is shown as a grey striped area and labelled 220, although in the illustrated embodiments it is not visible without looking inside the shoe. FIGS. 2D and 2F show an elastic strap attachment 204 that helps to keep the shoe connected to the foot. Such elastic straps 204 can be made up of two parts in an "X shape" arrangement as shown in the diagram or a single strap. The two part "X-shape" arrangement has been chosen for this embodiment as it maximises the connection between the heel portion of the shoe 210, the arch portion of the shoe 240 and the forefoot portion of the shoe 270. The "X-shape" maintains 4 contact points with the shoe, connecting the medial heel portion with the lateral forefoot section and the lateral heel section with the medial forefoot portion. In addition to assisting to reduce the effects of wrinkling and bunching of materials, this completes the support network connection, linking all portions of the shoe upper 201 with each other across the top of the foot. In other forms of footwear, laces can be used in addition to or as a replacement for straps 204.

Figure 10B:
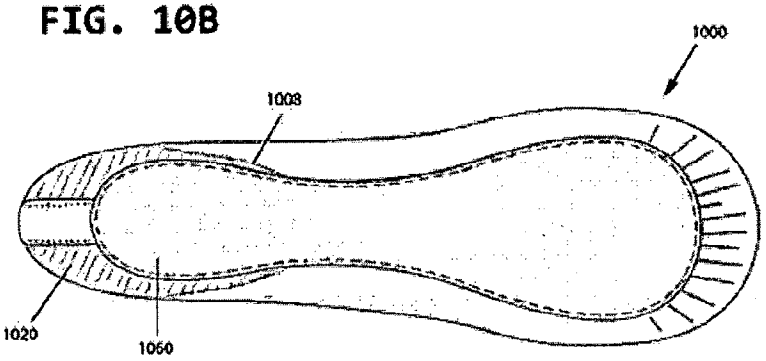
FIG. 10B is a bottom view of the full sole ballet slipper of FIG. 10A.
Figure 10C:
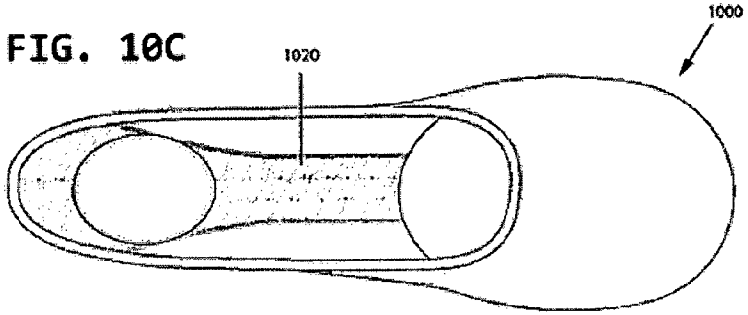
FIG. 10C is a top view of the full sole ballet slipper of FIG. 10A.
Figure 10A:
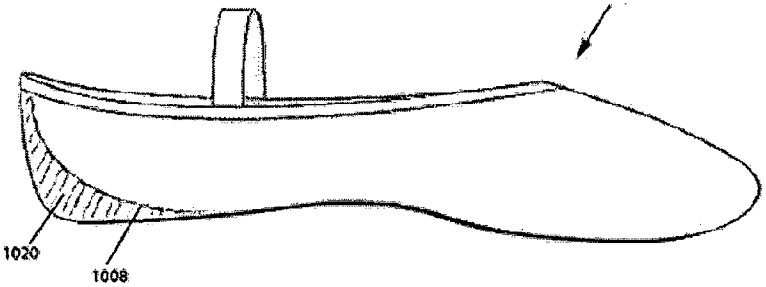
FIG. 10A is a side view of a full sole ballet slipper according to some embodiments.

In some embodiments, for example as shown in FIG. 10A, only a single strap 204 may be provided, extending across the foot opening defined by the shoe upper 201 and coupling to the shoe upper 201 adjacent its upper edge. Such a single strap 204 may be positioned to generally coincide with the arch section 240 or with a transition region between the arch section 240 and the heel section 210.

A binding 202 extends around an upper rim of shoe upper 201 of slipper 200 to define the opening through which the foot is received in the top of slipper 200. The binding 202 can be made up of a cotton non-stretch material with cotton drawstring, a cotton non-stretch material with elastic drawstring or an elastic binding with no drawstring. Binding 202 may be stitched, glued or otherwise affixed to the upper 201 and optionally also to the upper heel portion 222 of the semi-rigid material 220.

Reference numeral 201 indicates the upper of the shoe 200. The upper 201 may be formed as one piece stitched together through the heel and outsole or more than one piece of material. If the upper 201 is formed of one piece of material, then it extends around under portions of the heel, arch and forefoot sections to form part of the outsole. This may also be the case where the upper 201 is made up of more than one piece of fabric. The upper 201 can be made up of numerous stretch and non-stretch materials such as canvas, leather, PU, lycra, mesh, neoprene, mesh etc. Reference numeral 208 indicates the stitch line that connects the semi-rigid material 220 to the upper 201 and lining 203. The stitch line 208 defines (and runs just inside) the edge of the semi-rigid material 220 and connects it to the upper 201 of the shoe 200. This connection can alternatively be achieved with glue or a combination of glue and stitching.

The semi-rigid material 220 may be formed from a single piece of material. If two pieces of material are used to make up the semi-rigid material 220, they may be longitudinally joined to form a line of symmetry along the join (as in FIGS. 5A-5C). In some embodiments, different pieces and types of material, having different material characteristics, may be used to form the semi-rigid material 220 through the heel section 210 and the arch section 240.

The connection created by combining the semi-rigid material 220 to the body of the shoe 200 is significant as it is responsible for creating the semi-rigid but flexible reinforcing structure between the heel section 210 of the shoe 200, the outsoles 212, 272 of the shoe 200 and the arch section 240 of the shoe 200. For light ballet slippers in particular, it is what gives the shoe 200 its body and what allows the shoe material to maintain its shape and clean lines during movement. It also allows the shoe 200 to offer more support to the dancer's foot and ankle, maintaining a semi-rigid body of material against the foot and in turn offering controlled resistance for muscle activity. The shape and positioning of the semi-rigid material 220 is also significant to achieving the desired structural and aesthetic effects.

Starting at the binding 202 at the top of the heel section 210, the semi-rigid material 220 covers part of the back of the heel but is wide enough to start forming a slight curve as it extends down around the Achilles tendon and/or ankle bone. The semi-rigid material 220 continues down towards the sole of the heel, getting wider as it travels, forming a cup shape as it wraps itself around a lower posterior part of the heel bone (calcaneus). This transition from Achilles to sole and the corresponding gradual width increase in the semi-rigid material 220 is intended to serve as a gradual increase in the rigidity of the heel section 210 as it approaches the sole of the foot. The rigidity level is selected to provide flexibility, softness and ease of movement without compromising on support and resistance. If the semi-rigid material 220 maintained the same width through into the sole of the heel section 210 and did not become wider, the increased support around the heel would be lost, the resistance would be low and the ability of the semi-rigid material 220 to reduce wrinkles on and around the heel would be reduced.

As the semi-rigid material 220 approaches the arch section 240, the shape changes to roughly mimic the transitional contours of the arch. This requires a narrowing of the semi-rigid material 220 at the heel-arch transitional portion 227 and it is necessary to avoid excessive reinforcing material in the arch region 240. This narrowing means that the semi-rigid material 220 changes from a cup shape around the heel section 210 into a flat strip 228 as it progresses from the mid and lower heel portions 224, 226 into the arch section 240 to allow the foot to bend naturally. However, the semi-rigid material 220 should stay wide enough in the arch section 240 to offer support and controlled resistance. If the semi-rigid material 220 is too wide in the arch section 240, it would maintain the "cup" shape as seen in the heel section, and this would reduce flexibility through the arch. In some ballet slipper embodiments, the lateral width of the lower heel portion 226 of the semi-rigid material 220 may be between around 1.8 and 3 times the lateral width of the narrow strip portion 228 through the arch section 240.

FIG. 2E shows the back strap stitch 234 that connects the back strap 232 to the upper 201 and semi-rigid material 220. The backstrap 232 may be made from the same material as the upper 201 or it can be made of other stretch or non-stretch materials, woven or non-woven material types, including binding material. FIGS. 2B and 2E shows how the backstrap 232 continues through from the top of the heel section 210 and into the arch section 240, ending at forefoot outsole portion 272. The backstrap 232 is an optional part of the shoe 200. Reference numeral 229 indicates the arch-forefoot transitional portion of the semi-rigid material 220. The semi-rigid material 220 begins to broaden to about 1.5 to 3 times its width in the arch section 240 as it approaches the front outsole 272. This smoothes the transition from one semi-rigid material into another to reduce wrinkling, puckering and bunching of surrounding materials. However, in some embodiments, the semi-rigid material 220 maintains a substantially constant width through the arch-forefoot transitional portion.

The outsole of slipper 200 has heel and forefoot outsole parts 212, 272. In some illustrated diagrams, the outsole is a "split outsole" in two parts and may be made up of suede. However, other embodiments may employ a full sole, such as the embodiments illustrated in FIGS. 10A to 10C. In full sole ballet slipper embodiments, the outsole replaces much of the task performed by the semi-rigid material 220 in the arch section 240, but its connection to the semi-rigid material in the heel section 210 (and role as part of the reinforcing structure) is still significant. The heel and forefoot outsole portions 212, 272 are stitched in place with stitches 214, 274, respectively, connecting them to the upper 201 and semi-rigid material 220. A toe area of the forefoot section 270 may have a pleating arrangement which shapes the material of upper 201 around the toes.

As with the upper 201, the lining 203 can be made up of different stretch and non-stretch materials, such as canvas, leather, PU, Lycra, mesh, neoprene, cotton, for example. FIG. 2F shows the semi-rigid material 220 sitting on top of the lining 203, but it can alternatively be placed underneath the lining 203, in between the lining 203 and the upper 201, concealing the semi-rigid material 220, or the semi-rigid material 220 can be placed on the outside of the upper 201 in full view. Lining 203 can be made up of numerous materials like canvas, leather, PU, Lycra, mesh, neoprene, cotton as well as buoyant materials such as foams and its variants and rubbers and its variants. Lining 203 may be quite light and thin, with a soft feel to it.

The semi-rigid material 220 (and all equivalents described herein) may be formed of various different materials. Some particular embodiments comprise EVA foam. Such materials may further comprise rubber, such as natural rubber or a synthetic rubber (although synthetic rubber is preferred), in combination with the EVA foam. The EVA foam and rubber may be provided in roughly equal proportions or the material may consist of 40% to 60% EVA, 40% to 60% rubber and 0% to 20% other materials. In some embodiments, different proportions of EVA and rubber may be employed, with ranges of one of those components extending up to say 80% or 90%, with the remainder comprising the other component or other materials. In some embodiments, EVA foam may be used without any rubber.

The shape of heel and forefoot insole portions 207, 213 would normally match the general shape of the outsole. A stitch 215 or adhesive attaches the rear insole portion 207 to one or more of the upper 201, lining 203 and semi-rigid material 220. A similar stitch (not shown) or adhesive attaches the forefoot insole portion 213 to the upper 201 and/or lining 203 and optionally the forefoot outsole portion 272.

Figure 3:
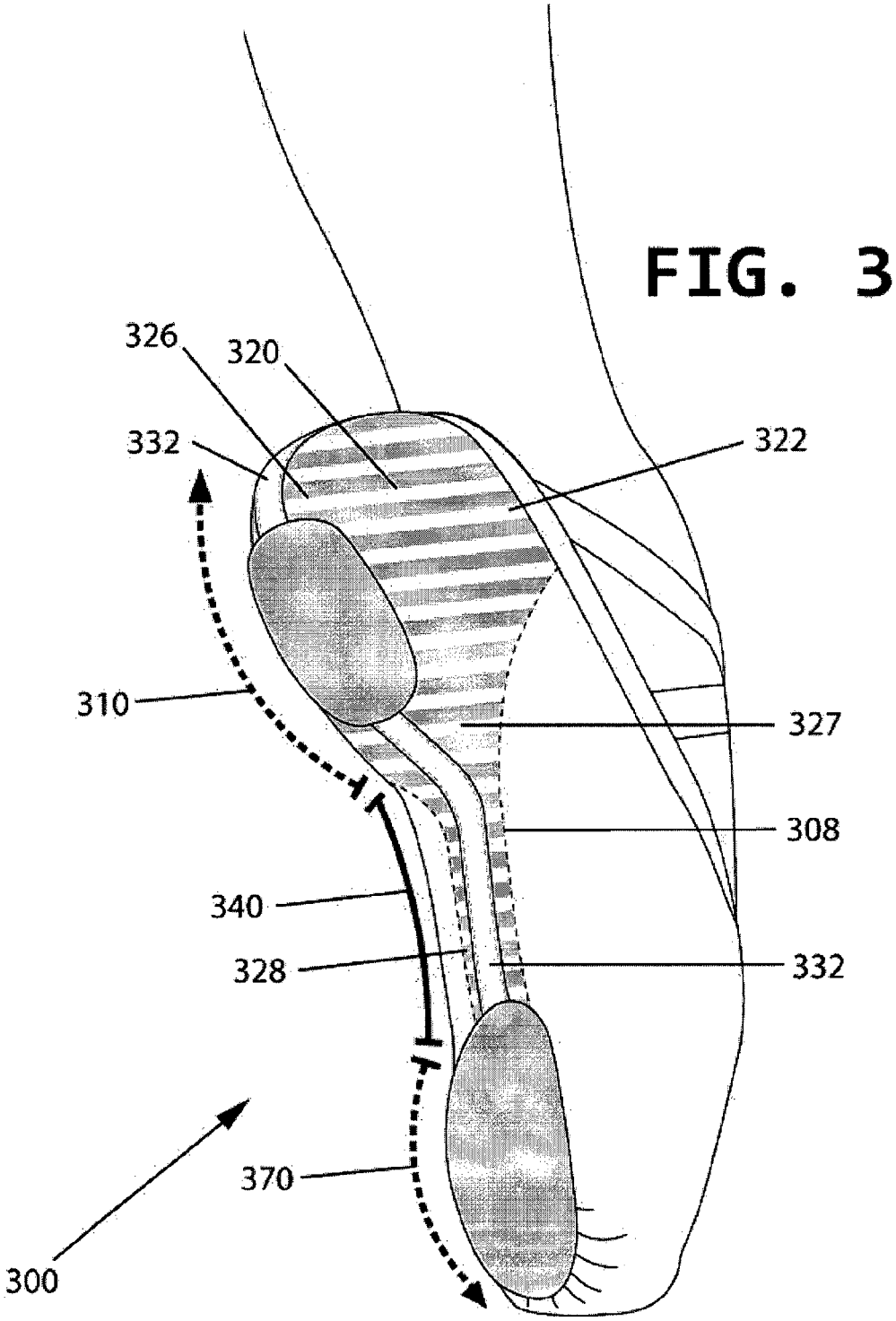
FIG. 3 shows a split sole ballet shoe of some embodiments in pointe position.

FIG. 3 illustrates an embodiment of a split sole ballet slipper 300. The features of slipper 300 are the same as slipper 200 described above, except that the cup shape formed by the semi-rigid material 320 is larger. The purpose of this illustration is to show how in some embodiments the semi-rigid material 320 can be larger around the heel than is outlined in FIGS. 2A to 2F. In embodiments of slipper 300, the semi-rigid material 320 forms a substantially larger cup around the heel of the foot starting at the upper heel portion 322 before it passes into the arch section. In such embodiments, the lateral width of the lower heel portion 326 of the semi-rigid material 320 may be between about 3 and about 8 times the lateral width of the narrow strip portion 328 through the arch section 340.

The design of FIG. 3 produces excellent results with regards to minimising creasing or bunching of materials around the heel and, provided the heel-arch transitional portion 327 is still appropriately positioned in line with the transitional contours of the heel into the arch, offers a beneficial amount of resistance to pointing and flexing of the foot in motion. The stitch 308 connecting the semi-rigid material 320 to the upper of the shoe is present, as is the optional backstrap 332.

FIGS. 4A, 4B, 4C, 4D and 4E illustrate embodiments of a split sole ballet slipper 400. The features of slipper 400 are the same as slipper 200 described above, except that it has a forward-located stretch panel 481 interrupting the upper 401 and outsole. The presence of a semi-rigid material 420 is shown as a grey striped area. In such embodiments, the semi-rigid material 420 is attached to the shoe upper 401 using a stitch 408 and/or adhesive, starting at the heel section 410 and extending along a line through the side or back quarter of the shoe 400, creating a heel "cup" and into the arch section 440. The semi-rigid material narrows as it passes through the heel-arch transitional portion 427 and forms a flat strip 428. Stitching 408, 414 and 434 connects the heel section 410, rear outsole 412 and arch section 440 in a semi-rigid, but flexible support structure. The semi-rigid material 420 continues through the arch section 440 and ends at the flexible front stretch panel 481.

Figures 4A, 4B:
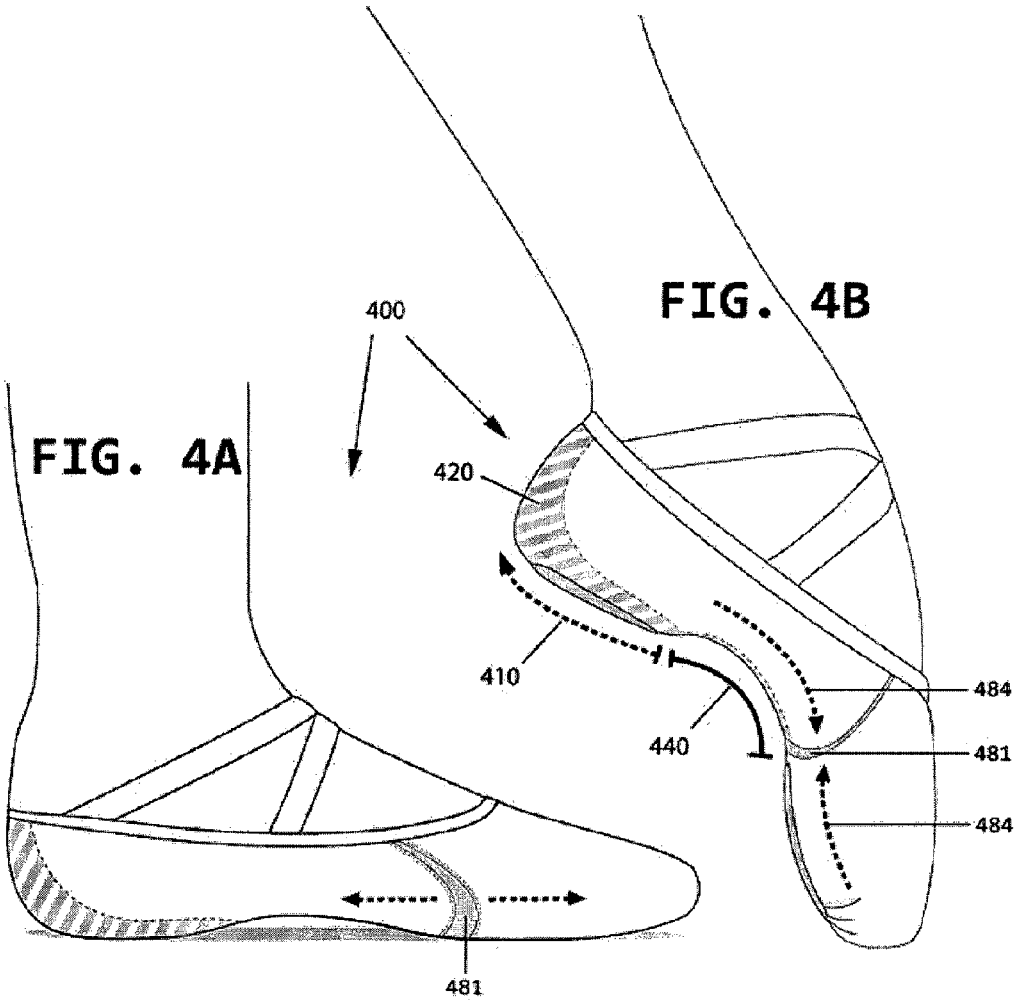
FIG. 4A shows a side view of a split sole ballet shoe according to some embodiments, with the dancer standing flat.
FIG. 4B shows the split sole ballet shoe of FIG. 4A in pointe position.
Figure 4C:
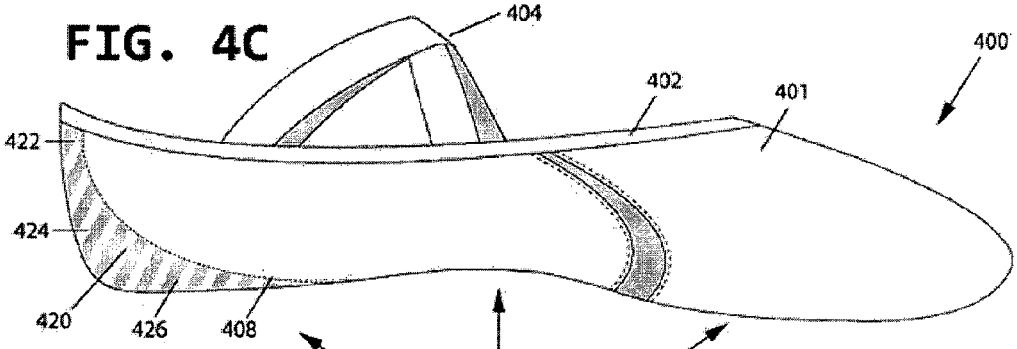
FIG. 4C shows a side view of the split sole ballet slipper of FIG. 4A with the semi-rigid material starting at the rear heel and finishing at a forward stretch panel.
Figure 4D:
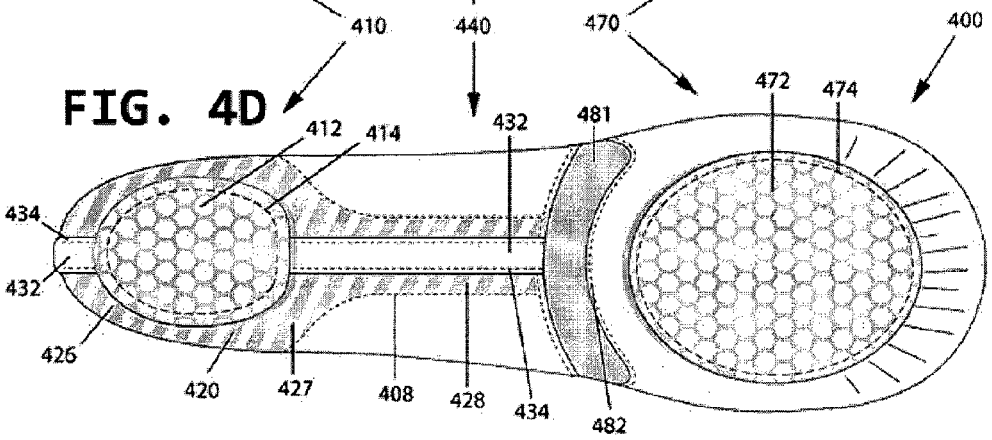
FIG. 4D shows a bottom view of the split sole ballet slipper of FIG. 4A.
Figure 4E:
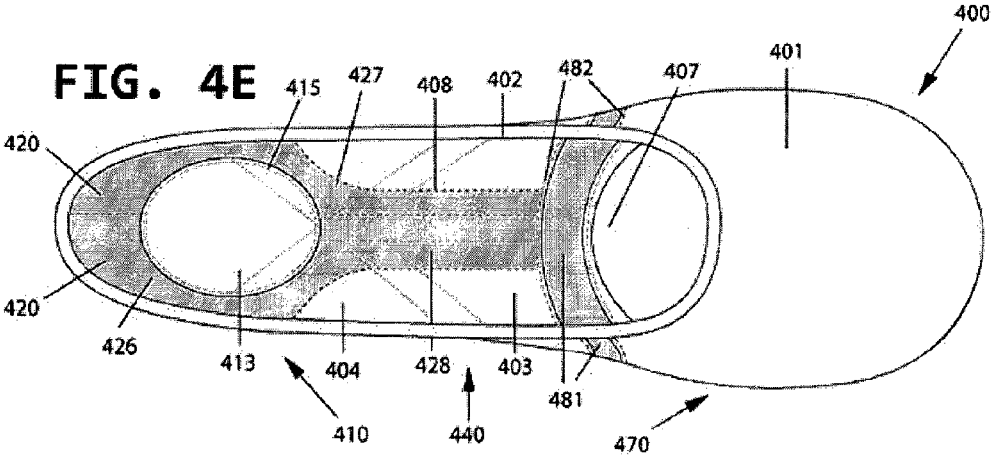
FIG. 4E shows a top view of the split sole ballet slipper of FIG. 4A.

FIG. 4D shows the back strap stitch 434 that connects the back strap 432 to the upper 401 and semi-rigid material 420. The backstrap 432 may be made from the same material as the upper 401 or it can be made of other stretch or non-stretch materials, woven or non-woven material types, including binding material. The backstrap 432 continues through from the top of the heel section 410 and into the arch section 440, ending at the flexible front stretch panel 481.

The stretch panel 481 is free of any coverings or other materials overlying it and can be made of a variety of stretch materials, for example such as Lycra, mesh, neoprene, stretch leather, stretch canvas, spandex, stretch PU etc. The purpose of the stretch panel is to dissipate bunching or travel of the shoe material relative to the foot when the foot is in motion, bending and flexing. Rather than the shoe material travelling (relative to the foot) forwards and backwards to the heel and toe sections, the change in length of the foot is compensated for by expansion or retraction of the stretch panel.

When a dancer is standing flat in a neutral position, the stretch panel 481 is longitudinally expanded (see FIG. 4A). When the dancer's foot is in pointe position (see FIG. 4B), the stretch panel 481 contracts in the manner illustrated by arrows 484. The stretch panel 481 also acts as a size leeway, allowing the wearer a more custom fit. The presence of a semi-rigid material 420 encasing or "cupping" the heel and surrounding the arch, all joined as one piece, increases support levels for the foot and ankle, and offers controlled resistance.

The stretch panel 481 is shaped and located so as to be widest where it underlies the foot and effectively forms part of the outsole in a transition region between the arch section 440 and the forefoot section 470. Stretch panel 481 extends around and up from the outsole region on each lateral side of the slipper 400, narrowing in width and curving in a rearward sweep until it terminates at the binding 402. As the greatest amount of expansion or contraction of the stretch panel occurs in the outsole region, the stretch panel 481 can be narrower and afford less expansion/contraction as it extends toward the binding 402. Stretch panel 481 is stitched to adjacent parts of upper 401 and outsole portions, including the forward-most extent of semi-rigid material 420 (at arch portion 428) and optionally also backstrap 432.

The shape of stretch panel 481 is such that, if flattened, it resembles a "W". This is because stretch panel 481 is arc-shaped in a central area where it forms part of the outsole, providing a concave shape toward the forefoot section 470 (and a convex shape toward the arch and heel sections 440, 410), with the lateral wings of stretch panel 481 curving back toward the heel section 410. As the stretch panel 481 travels towards the binding 402 of the shoe, it continues to curve in an arc-shape fashion along the side panel of the shoe. This shape is designed to match the contours of the side of the foot and to visually compliment design curves found throughout the shoe.

Figure 4F:
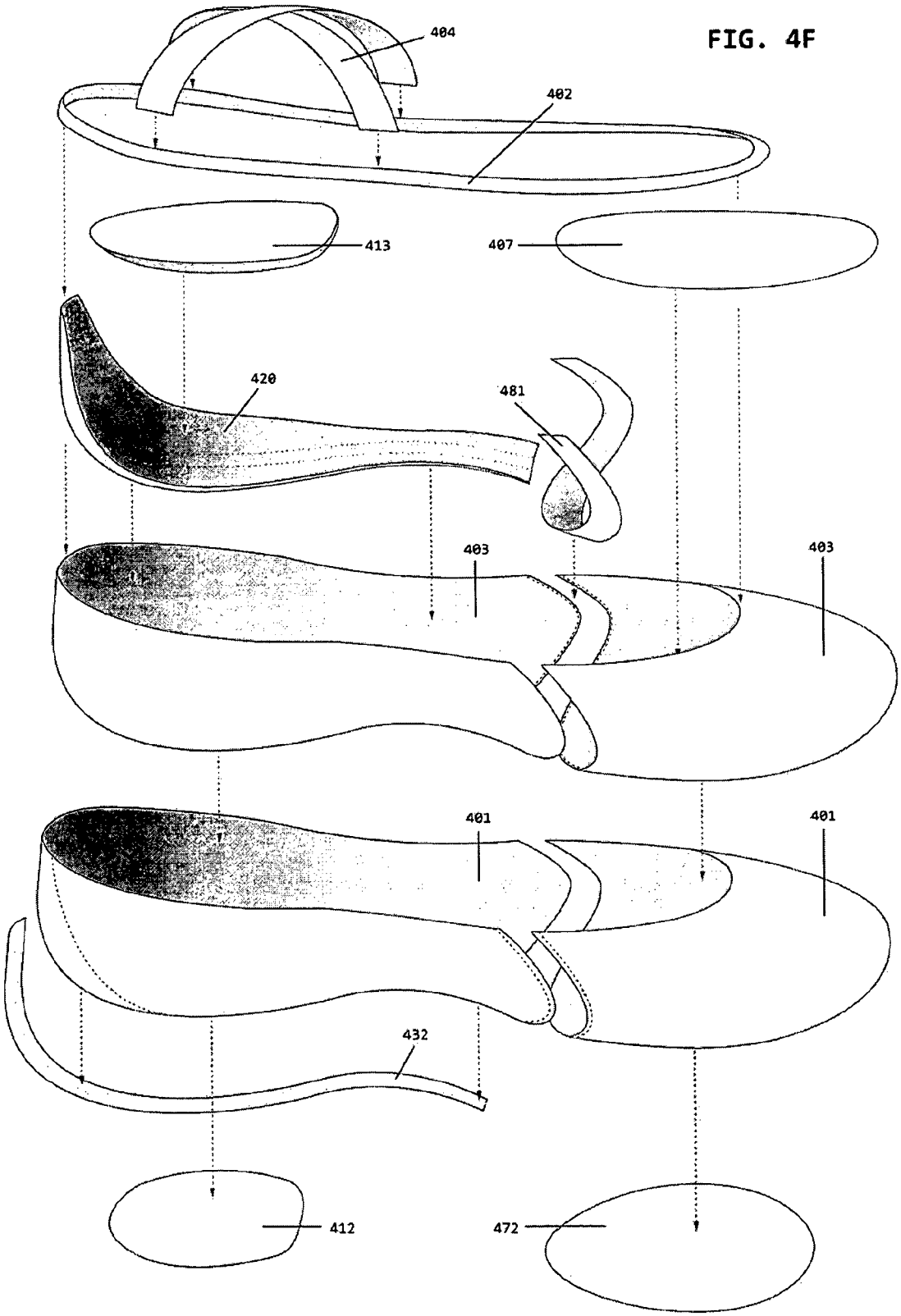
FIG. 4F is an exploded diagram of the ballet shoe of FIG. 4A.

FIG. 4F is an exploded view of the shoe 400, illustrating layers and components. Elastic strap attachments 404 help to keep the shoe 400 on the wearer's foot. The elastic straps 404 can be made up of two parts in an "X shape" arrangement as shown in the diagram or alternatively as a single strap. The elastic straps 404 are attached to the upper 401, lining 403 and binding 402. The binding 402 is sewn to the upper 401 and lining 403 and the semi-rigid material 420 at its upper heal portion 422. The rear insole 413 and lining 403 are sewn or adhered to the semi-rigid material 420 by stitching 414, 408. The front insole 407 is sewn to the lining 403 by stitching 474 or may be adhered thereto.

The semi-rigid material 420 is attached to the upper 401 and lining 403. The semi-rigid material 420 can be attached on the inside of the shoe, on top of the lining 403 as shown in FIG. 4F or in between the lining 403 and the upper 401. The semi-rigid material 420 can alternatively be attached on the outside of the shoe, outside of the upper 401 in full view. The stretch panel 481 is sewn to the upper 401 and lining 403 by stitching 482. The lining 403 is layered into the upper 401. The backstrap 432 is attached to the upper 401 and the sole of shoe 400 by stitching 434. The rear outsole portion 412 and front outsole portion 472 are stitched to the upper 401 by stitching 414 and 474 respectively.

The layers and components and their attachments (e.g. by stitching) for slippers 200, 300 and 600 (FIGS. 6A to 6E) are the same or similar to those shown and described above in relation to slipper 400, except for the presence and location of stretch panel 481.

Figure 5A:
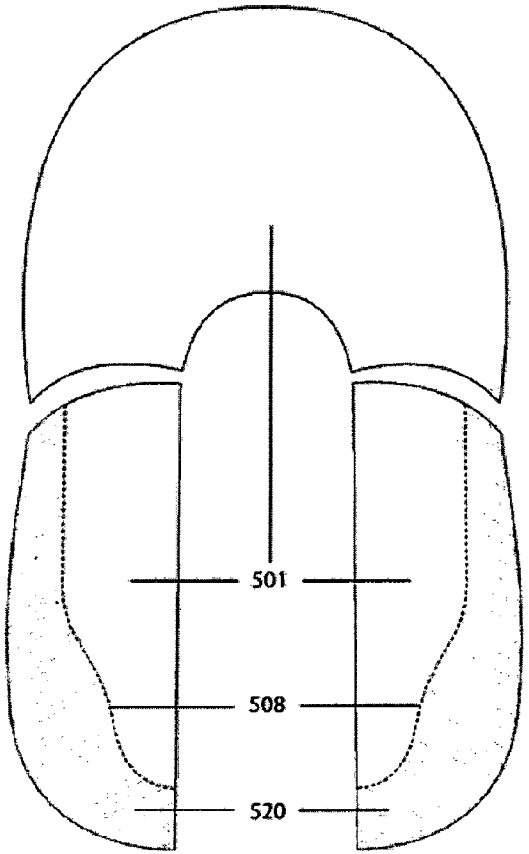
FIGS. 5A, 5B and 5C illustrate steps of a construction process involving application of a semi-rigid material to a ballet shoe.
Figure 5B:
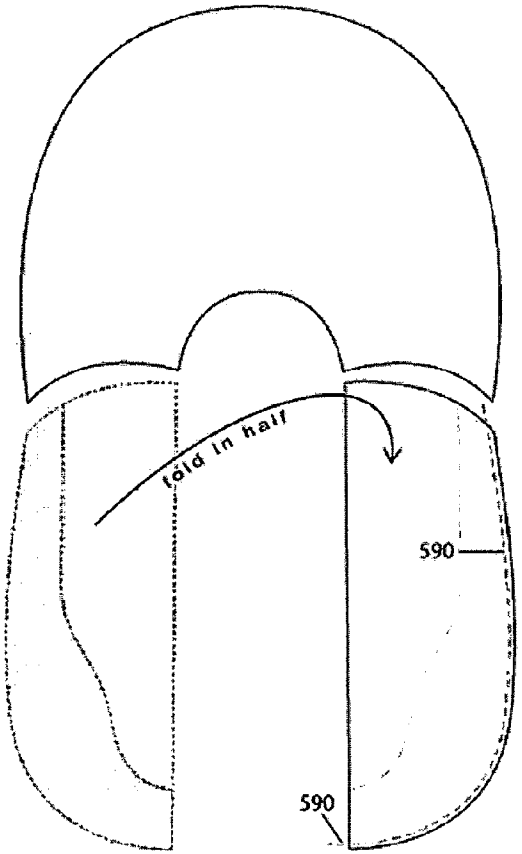
Figure 5C:
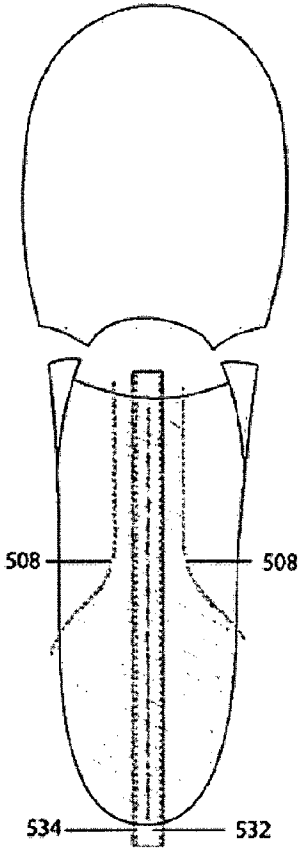

FIGS. 5A, 5B and 5C schematically illustrate steps of part of a shoe construction process of slipper 400 (as one example) including the application of the semi-rigid material of some embodiments. Similar principles of construction apply to the different embodiments described herein. The first step is shown in FIG. 5A and involves attaching the semi-rigid material 520 to back quarter panels 501 of the shoe upper and linings. This is done by either gluing or stitching 508 the semi-rigid material 520 to the lining/upper 501, or a combination of gluing and stitching. The two panels 501 of back quarter upper and lining, plus the semi-rigid material 520 are then arranged one on top of the other, as shown in FIG. 5B. The two panel halves 501 are then secured together with one stitch line 590. The two halves 501 are then opened and secured by a second centre stitch 534 on the inside of the shoe and on the outside of the shoe with a backstrap 532, as shown in FIG. 5C. This process combines the semi-rigid material with the other shoe components to achieve a balance between rigid support and flexibility. It also gives the heel section a cupped shape that generally follows the contours of a dancer's heel without the need for moulds. The cupping of the heel by the semi-rigid material is achieved by providing curvature in both lateral and longitudinal directions around the back, bottom and sides of the heel.

FIGS. 6A, 6B, 6C, 6D and 6E illustrate embodiments of a split sole ballet slipper 600. Slipper 600 is similar to slipper 400, except that it has a rear-located stretch panel 691 interrupting the upper 610 and outsole. A semi-rigid material 620 is shown as a grey striped area. In such embodiments, a rear located stretch panel 691 and its stitching 692 is present. The semi-rigid material 620 is attached to the shoe upper 601 using a stitch 608 and/or adhesive, starting at the forefoot section 670 of the shoe 600 and flowing along a longitudinal direction, such as a center-line, through the arch section 640. This stitch 608 and/or adhesive connect the semi-rigid material 620 to both the upper 601 and its linings 603 or just its upper 601 or linings 603.

Just as in other described embodiments, the shape and positioning of the semi-rigid material 620 is also significant to achieving desired effects. The semi-rigid material in the arch section 628 should be narrow enough to allow full range of movement of the foot, but wide enough to offer support and controlled resistance as well as to help maintain a smooth line with no wrinkling or puckering of material.

A back strap material 632 and its stitching 634 is also attached through into the arch section 640. This connects the front outsole section 672 and its stitching 674, the front insole 607 and arch section 640 in a semi-rigid, but flexible support structure. Reference numeral 629 indicates the arch-forefoot transitional portion of the semi-rigid material 620. The semi-rigid material 620 narrows as it moves away from the front outsole 672. This smoothes the transition from one semi-rigid material, the suede outsole 672 into another, 620 to reduce wrinkling, puckering and bunching of surrounding materials. The semi-rigid material 620 continues through the arch section 640 and ends at flexible rear stretch panel 691.

The stretch panel 691 is free of any coverings or other shoe upper or outsole materials overlying it and can be made of a variety of stretch materials, for example such as Lycra, mesh, neoprene, stretch leather, stretch canvas, spandex, stretch PU etc. The stretch panel 691 serves to mitigate relative longitudinal movement of the shoe material compared to the foot when the foot is in motion, bending and flexing. Rather than the material seemingly travelling forwards and backwards to the heel and toe sections, the relative movement is at least partially absorbed through the stretch panel 691. The stretch panel 691 also acts as a size leeway, allowing the wearer a more custom fit.

Figures 6A, 6B:
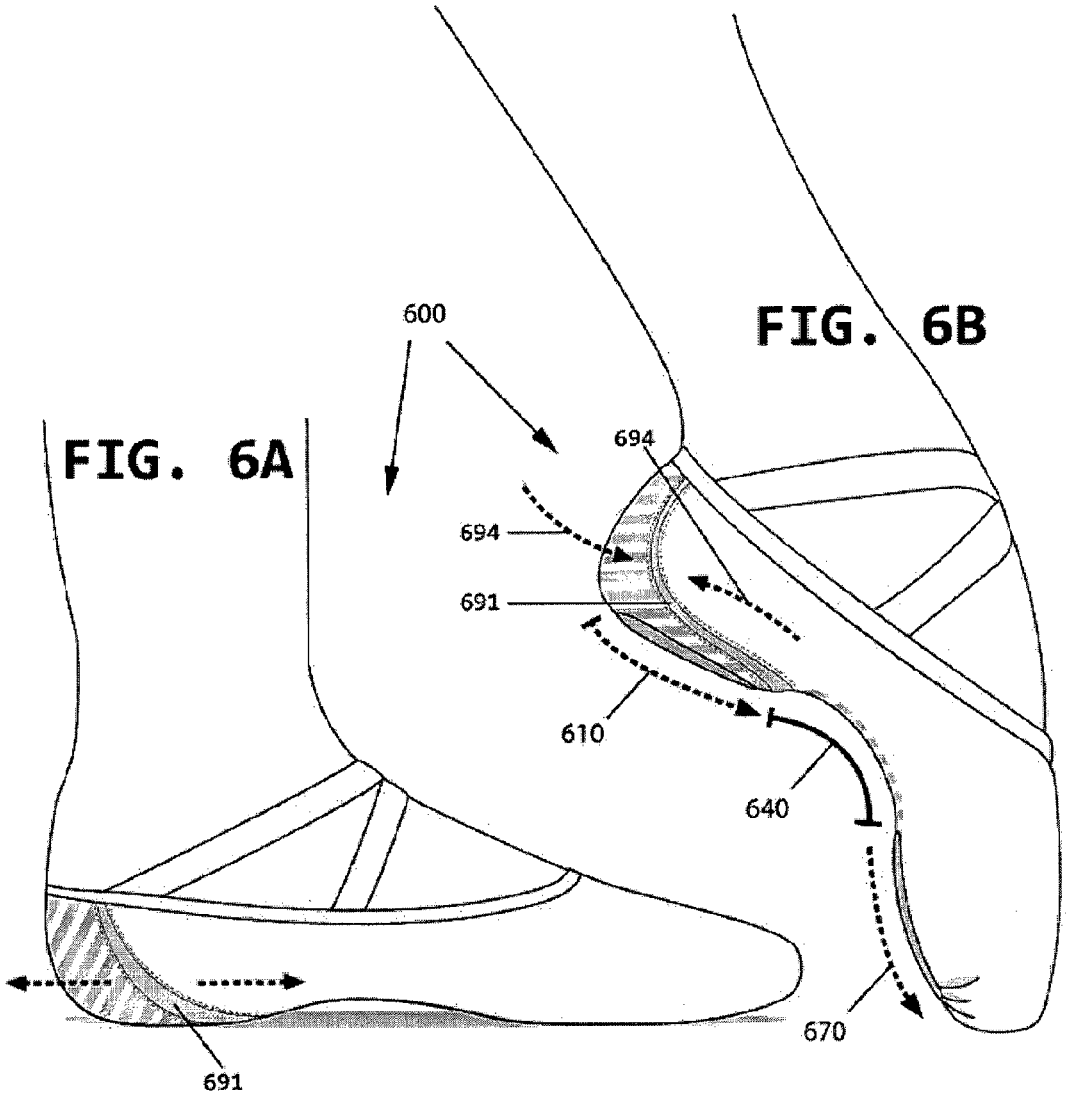
FIG. 6A shows a side view of the split sole ballet shoe according to further embodiments, with the dancer standing flat.
FIG. 6B shows a side view of the split sole ballet shoe of FIG. 6A in pointe position.
Figure 6C:
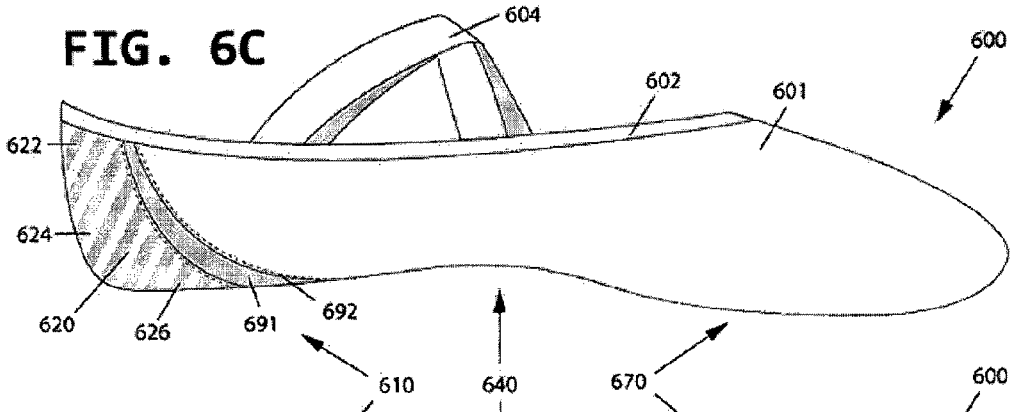
FIG. 6C shows a side view of the split sole ballet slipper of FIG. 6A.
Figure 6D:
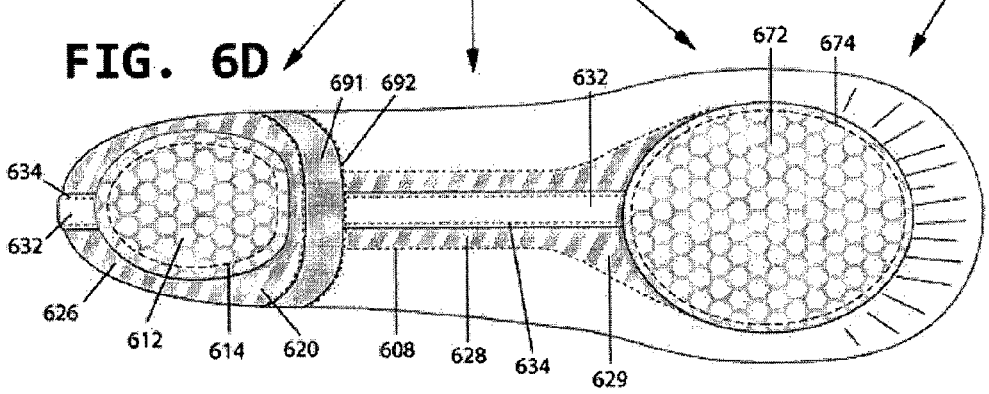
FIG. 6D shows a bottom view of the split sole ballet slipper of FIG. 6A.
Figure 6E:
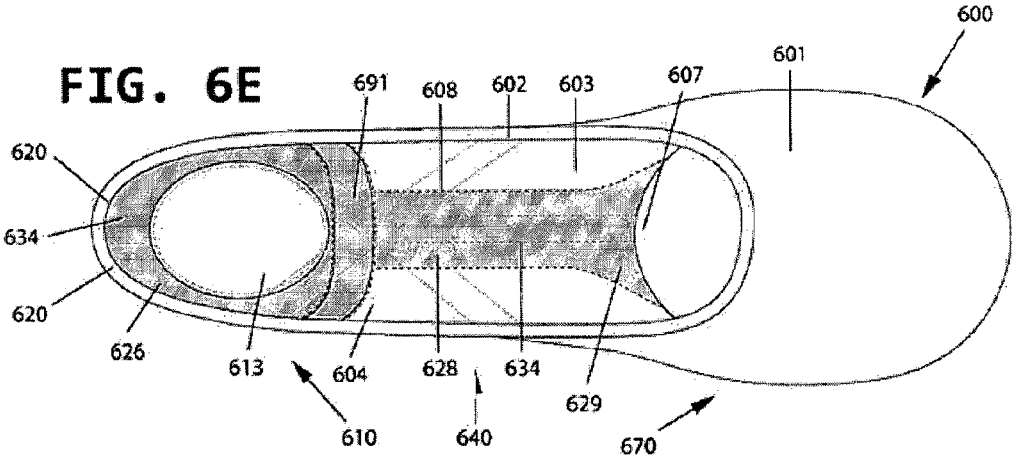
FIG. 6E shows a top view of the split sole ballet slipper of FIG. 6A.

When a dancer is standing flat in a neutral position, the stretch panel is extended (see FIG. 6A). When the dancer's foot is in pointe position (see FIG. 6B) the stretch panel 691 contracts in the manner shown by arrows 694. The presence of a semi-rigid material 620 encasing the heel and supporting the arch increases support levels for the foot and ankle, and offers controlled resistance.

The stretch panel 691 is shaped and located so as to be widest where it underlies the foot and effectively forms part of the outsole in a transition region between the arch section 640 and the heel section 610. Stretch panel 691 generally resembles a U-shape when flattened or viewed from each end of the shoe 600, extending around and up from the outsole region on each lateral side of the slipper 600, narrowing in width and curving in a rearward sweep until it terminates at the binding 602 near the upper heal portion 622. As the greatest amount of expansion or contraction of the stretch panel occurs in the outsole region, the stretch panel 691 can be narrower and afford less expansion/contraction as it extends toward the binding 602. Stretch panel 691 is stitched to adjacent parts of upper 601 and outsole portions, including adjacent forward and rear portions of semi-rigid material 620 (at arch section 640 and heel section 610) and optionally also a forwardly located backstrap 632.

The semi-rigid material 620 encasing or cupping the heel section 610 is still present but is separated from a front section semi-rigid material 620 by the back stretch panel 691. The heel section of the semi-rigid material 620 serves to increase support for the heel and ankle and ensure a clean smooth material line around the heel. These semi-rigid material sections 620 provide a reinforcing structure for the shoe 600 to increase support levels for the foot and ankle, and offer controlled resistance to foot flexion.

The semi-rigid material 620 is attached to the upper 601 and lining 603. The semi-rigid material 620 can be attached on the inside of the shoe, on top of the lining 603 as shown in FIGS. 6A to 6E or in between the lining 603 and the upper 601. The semi-rigid material 620 can alternatively be attached on the outside of the shoe, outside of the upper 601 in full view. The stretch panel 691 is sewn to the upper 601 and lining 603 by stitching 692. The lining 603 is layered into the upper 601. The backstrap 632 is attached to the upper 601 and the sole of shoe 600 by stitching 634. The rear outsole portion 612 and front outsole portion 672 are stitched to the upper 601 by stitching 614 and 674 respectively.

FIGS. 7A, 7B, 7C and 7D illustrate embodiments of a leather split sole lace up jazz shoe 700. FIGS. 7A to 7D show the side, bottom perspective, top and bottom views of the lace up jazz shoe 700. The Jazz shoe 700 has a heel section 710, an arch section 740 and a forefoot section 770. FIGS. 7A to 7D show a semi-rigid material indicated as a grey striped area and labelled 720, although in the illustrated embodiments it is not visible without looking inside the shoe. The semi-rigid material 720 is applied as a reinforcing structure through the heel and arch sections 710, 740.

In the illustrated embodiments, the semi-rigid material 720 is stitched inside the shoe 700, progressing from an upper heel portion 722 of the heel section 710 and travelling down through a mid-heel portion 724, around a lower heel portion 726 through the heel outsole portion 712 and along a longitudinal centre-line of the arch section 740. The heel back strap 732 also continues into the arch section 740 underneath the heel outsole portion 712. These components combine to give the shoe more body with a smooth finish, and mitigate wrinkling in the material of the shoe upper 701.

Similar to a ballet shoe as shown in FIGS. 1A and 1B, the material of a jazz shoe may move relative to the foot when foot flexion occurs and this is apparent from the creation of a small void of space between the foot and the ends of the shoe in the heel section 710 and toe area of the forefoot section 770 when the foot flexes to pointe position. The semi-rigid material 720 and the stitch 708 connecting it to the body of the shoe 700, extend from the heel section 710 through the rear outsole 712 and into the arch section 740, connecting to the forefoot outsole portion 772 of forefoot section 770. A cup shape formed by the reinforcing structure provided by semi-rigid material 720 in the heel section 710 and the flexible arch section 740 maintain a relatively rigid smooth clean line, with minimal wrinkling, bunching or puckering of fabric.

Figures 7A, 7B, 7C, 7D:
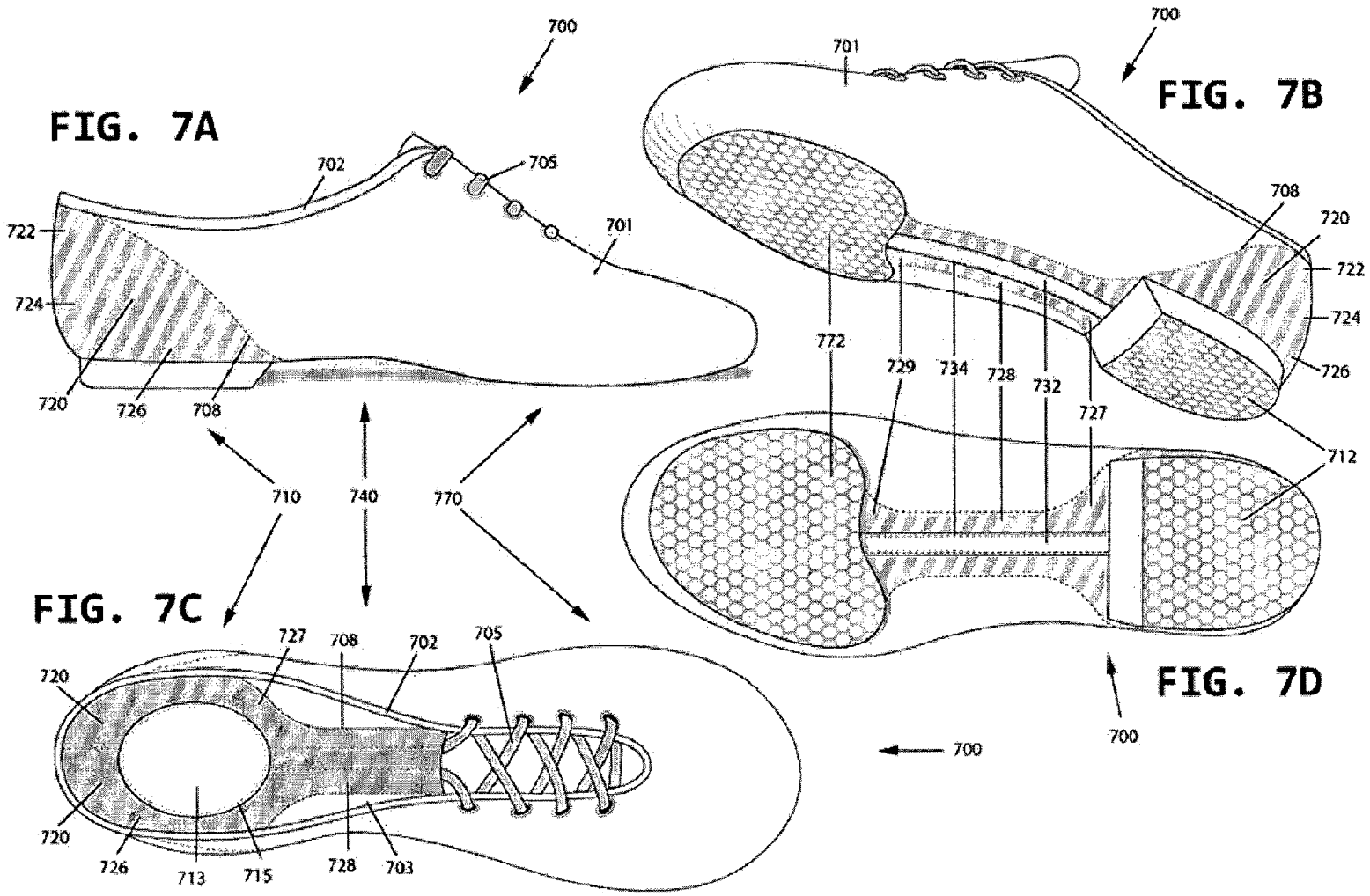
FIG. 7A shows a side view of a split sole jazz shoe of some embodiments.
FIG. 7B shows a bottom perspective view of the split sole jazz shoe of FIG. 7A.
FIG. 7C shows a top view of the split sole jazz shoe of FIG. 7A.
FIG. 7D shows a bottom view of the split sole jazz shoe of FIG. 7A.

FIGS. 7A, 7B and 7C show a lacing system 705 that helps secure the shoe to the foot. In other embodiments the lacing system 705 can be replaced by elastic straps or panels to create a laceless shoe referred to as a "slip-on". A binding 702 extends around an upper rim of the shoe 700 to define the opening through which the foot is received in the top of shoe 700 and can be made up of a cotton non-stretch material or an elastic stretch material. Some embodiments of a jazz shoe contain no binding at all and these are manufactured using the method known as "stitch and turn". Binding 702 may be stitched, glued or otherwise affixed to the upper 701 and optionally also to the upper heel portion 722 of the semi-rigid material 720.

Reference numeral 701 indicates the upper of the shoe 700. The upper 701 may be formed as one piece stitched together through the heel and outsole or more than one piece of material. If the upper 701 is formed of one piece of material, then it extends around under portions of the heel, arch and forefoot sections to form part of the outsole. This may also be the case where the upper 701 is made up of more than one piece of fabric. The upper 701 can be made up of numerous stretch and non-stretch materials such as canvas, leather, PU, lycra, mesh, neoprene, mesh etc. Reference numeral 708 indicates the stitch line that connects the semi-rigid material 720 to the upper 701 and lining 703. The stitch line 708 runs just inside the edge of the semi-rigid material 720 and connects it to the upper 701 of the shoe 700. This connection can alternatively be achieved with glue or a combination of glue and stitching.

The semi-rigid material 720 may be formed from a single piece of material. If two pieces of material are used to make up the semi-rigid material 720, they may be longitudinally joined to form a line of symmetry along the join (as in FIGS. 5A-5C). In some embodiments, different pieces of material, having different material characteristics, may be used in the heel section 710 and the arch section 740.

The connection created by combining the semi-rigid material 720 to the body of the shoe 700 is significant as it is responsible for creating the semi-rigid but flexible reinforcing structure between the heel section 710 of the shoe 700, the outsoles 712, 772 of the shoe 700 and the arch section 740 of the shoe 700. For light jazz shoes in particular, it is what gives the shoe 700 its body and what allows the shoe material to maintain its shape and clean lines during movement. It also allows the shoe 700 to offer more support to the dancer's foot and ankle, maintaining a semi-rigid body of material against the foot and in turn offering controlled resistance for muscle activity. The shape and positioning of the semi-rigid material 720 is also significant to achieving the desired structural and aesthetic effects.

Starting at the binding 702 at the top of the heel section 710, the semi-rigid material 720 covers part of the back of the heel but is wide enough to start forming a slight curve as it extends down around the Achilles tendon and/or ankle and heel bones (talus and calcaneus). The semi-rigid material 720 continues down towards the sole of the heel, getting wider as it travels, forming a cup shape as it wraps itself around a lower posterior part of the heel bone (calcaneus). This transition from Achilles to sole and the corresponding gradual width increase in the semi-rigid material 720 is intended to serve as a gradual increase in the rigidity of the heel section 710 as it approaches the sole of the foot. The rigidity level is selected to provide flexibility and ease of movement without compromising on support and resistance. If the semi-rigid material 720 maintained the same width through into the sole of the heel section 710 and did not become wider, the increased support around the heel would be lost, the resistance would be low and the ability of the semi-rigid material 720 to reduce wrinkles on and around the heel would be reduced.

As the semi-rigid material 720 approaches the arch section 740, the shape changes to roughly accommodate the transitional contours of the arch. This requires a narrowing of the semi-rigid material 720 at the heel arch transitional portion 727 and assists to avoid excessive reinforcing material in the arch region 740. This narrowing means that the semi-rigid material 720 changes from a cup shape around the heel section 710 into a flat strip 728 as it progresses from the mid and lower heel portions 724, 726 into the arch section 740 to allow the foot to bend naturally. However, the semi-rigid material 720 should stay wide enough in the arch section 740 to offer support and controlled resistance. If the semi-rigid material 720 is too wide in the arch section 740, it would maintain the "cup" shape as seen in the heel section, and this would reduce flexibility through the arch. In some jazz shoe embodiments, the lateral width from the longitudinal center-line to stitching 708 of the lower heel portion 726 of the semi-rigid material 720 may vary between around 1.8 and around 10 or more times the lateral width of the narrow strip portion 728 through the arch section 740. This may also apply to jazz shoe embodiments 800 and 900, described below.

FIGS. 7B and 7D shows the back strap stitch 734 that connects the back strap 732 to the upper 701 and semi-rigid material 720. The backstrap 732 may be made from the same material as the upper 701 or it can be made of other stretch or non-stretch materials, woven or non-woven material types, including binding material. FIGS. 7B and 7D shows how the backstrap 732 continues through from the top of the heel section 710 and into the arch section 740, ending at forefoot outsole portion 772. The backstrap 732 is an optional part of the shoe 700. Reference numeral 729 indicates the arch-forefoot transitional portion of the semi-rigid material 720.

In some embodiments the semi-rigid material 720 broadens to about 1.2 to 3 times its narrowest width in the arch section 740 as it approaches the front outsole 772. This smoothes the transition from one semi-rigid material into another to mitigate wrinkling, puckering and bunching of surrounding materials. In other embodiments, the width of the semi-rigid material 720 may remain substantially constant through the arch-forefoot transition section.

The outsole of shoe 700 has heel and forefoot outsole parts 712, 772. In illustrated diagrams, the outsole is a "split outsole" in two parts and may comprise EVA (Ethylene-vinyl acetate), for example. However, other embodiments may employ a full sole. In full sole embodiments, the outsole replaces much of the task performed by the semi-rigid material 720 in the arch section 740, but its connection to the semi-rigid material in the heel section 710 (and role as part of the reinforcing structure) is still significant. The heel and forefoot outsole portions 212, 272 are glued in place, connecting them to the upper 701 and semi-rigid material 720. A toe area of the forefoot section 770 may have a pleating arrangement which shapes the material of upper 701 around the toes.

As with the upper 701, the lining 703 can be made up of different stretch and non-stretch materials, such as canvas, leather, PU, Lycra, mesh, neoprene, cotton, for example. FIG. 7C shows the semi-rigid material 720 sitting on top of the lining 703, but it can alternatively be placed underneath the lining 703, in between the lining 703 and the upper 701, concealing the semi-rigid material 720, or the semi-rigid material 720 can be placed on the outside of the upper 701 in full view. Lining 703 can be made up of numerous materials like canvas, leather, PU, Lycra, mesh, neoprene, cotton as well as buoyant materials such as foams and its variants and rubbers and its variants.

The shape of heel insole portion 713 and forefoot insole portion (not shown) would normally match the general shape of the outsole. A stitch 715 attaches the rear insole portion to the upper 701, lining 703 and semi-rigid material 720. A similar stitch (not shown) attaches the forefoot insole portion to the upper 701, lining 703 and optionally the forefoot outsole portion 772. Alternatively, an adhesive substance may be used to attach such parts together.

FIGS. 8A, 8B, 8C and 8D illustrate embodiments of a leather split sole lace up jazz shoe 800. Shoe 800 is the same as shoe 700, except that it has a forward-located stretch panel 881 interrupting the upper 801 and outsole. FIGS. 8A to 8D show the side, bottom perspective, top and bottom views of the lace up jazz shoe 800. The presence of a semi-rigid material 820 is shown as a grey striped area and labelled 820. In such embodiments, the semi-rigid material 820 is attached to the shoe upper 801 using a stitch 808 and/or adhesive, starting at the heel section 810 and extending along a line through the side or back quarter of the shoe 800, creating a heel cup, and into the arch section 840. The semi-rigid material 820 narrows as it passes through the heel-arch transitional portion 827 and forms a flat strip 828. Stitching 808 and 815 and/or adhesive substances connects the heel section 810, rear outsole 812 and arch section 840 in a semi-rigid, but flexible support structure. The semi-rigid material 820 continues through the arch section 840 and ends at the flexible front stretch panel 881.

Figures 8A, 8B, 8C, 8D:
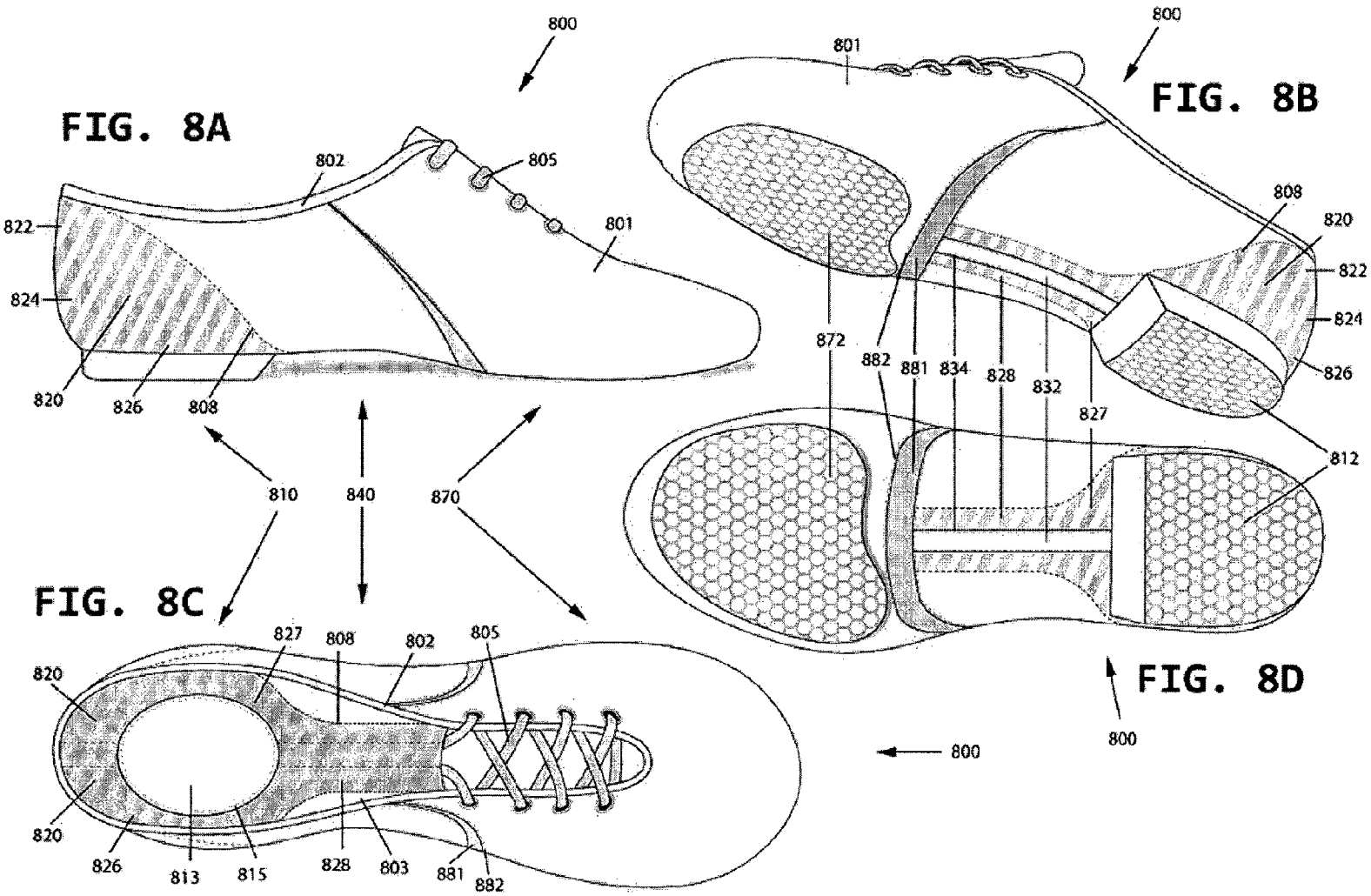
FIG. 8A shows a side view of the split sole jazz shoe according to further embodiments.
FIG. 8B shows a bottom perspective view of the split sole jazz shoe of FIG. 8A.
FIG. 8C shows a top view of the split sole jazz shoe of FIG. 8A.
FIG. 8D shows a bottom view of the split sole jazz shoe of FIG. 8A.

FIGS. 8B and 8D show the back strap stitch 834 that connects the back strap 832 to the upper 801 and semi-rigid material 820. The backstrap 832 may be made from the same material as the upper 801 or it can be made of other stretch or non-stretch materials, woven or non-woven material types, including binding material. The back strap 832 continues through from the top of the heel section 810 and into the arch section 840, ending at the flexible front stretch panel 881.

The stretch panel 881 is free of any coverings or other materials of the shoe upper 801 or outsole overlying it and can be made of a variety of stretch materials, for example such as Lycra, mesh, neoprene, stretch leather, stretch canvas, spandex, stretch PU etc. The purpose of the stretch panel is to dissipate bunching or travel of the shoe material relative to the foot when the foot is in motion, bending and flexing. Rather than the shoe material travelling (relative to the foot) forwards and backwards to the heel and toe sections, the change in length of the foot is compensated for by expansion or retraction of the stretch panel.

When a dancer is standing flat in a neutral position, the stretch panel 881 is longitudinally expanded. When the dancer's foot is in pointe position, the stretch panel 881 contracts. The stretch panel 881 also acts as a size leeway, allowing the wearer a more custom fit. The presence of a semi-rigid material 820 encasing or cupping the heel and surrounding the arch, all joined as one piece, increases support levels for the foot and ankle, and offers controlled resistance.

The stretch panel 881 is shaped and located so as to be widest where it underlies the foot and effectively forms part of the outsole in a transition region between the arch section 840 and the forefoot section 870. Stretch panel 881 generally resembles a U-shape when flattened or viewed from each end of the shoe 800, extending around and up from the outsole region on each lateral side of the shoe 800, narrowing in width and curving in a rearward sweep until it terminates at the binding 802. As the greatest amount of expansion or contraction of the stretch panel occurs in the outsole region, the stretch panel 881 can be narrower and afford less expansion/contraction as it extends toward the binding 802. Stretch panel 881 is stitched to adjacent parts of upper 801 and outsole portions, including the forward-most extent of semi-rigid material 820 (at arch portion 828) and optionally also backstrap 832.

The semi-rigid material 820 is attached to the upper 801 and lining 803. The semi-rigid material 820 can be attached on the inside of the shoe, on top of the lining 803 as shown in FIG. 8C or in between the lining 803 and the upper 801. The semi-rigid material 820 can alternatively be attached on the outside of the shoe, outside of the upper 801 in full view. The stretch panel 881 is sewn to the upper 801 and lining 803 by stitching 882. The lining 803 is layered into the upper 801. The backstrap 832 is attached to the upper 801 and the sole of shoe 800 by stitching 834. The rear outsole portion 812 and front outsole portion 872 may be glued to the upper 801.

FIGS. 9A, 9B, 9C and 9D illustrate embodiments of a leather split sole lace up jazz shoe 900. Shoe 900 is the same as shoe 700, except that it has a rear-located stretch panel 991 interrupting the upper 901 and outsole through the heel section 910.

A semi-rigid material 920 is shown as a grey striped area. The semi-rigid material 920 is attached to the shoe upper 901 using a stitch 908 and/or adhesive, starting at the forefoot section 970 of the shoe 900 and flowing along a longitudinal center-line through the arch section 940. This stitch 908 and/or adhesive connect the semi-rigid material 920 to both the upper 901 and its linings 903 or just its upper 901 or linings 903. Just as in other described embodiments, the shape and positioning of the semi-rigid material 920 is also significant to achieving desired effects. The semi-rigid material in the arch section 928 should be narrow enough to allow full range of movement of the foot, but wide enough to offer support and controlled resistance as well as to help maintain a smooth line with no wrinkling or puckering of material.

A back strap material 932 and its stitching 934 is optionally also attached, extending from the forefoot outsole portion 972 through into the arch section 940. This connects the front outsole section 972, the front insole (not shown) and arch section 940 in a semi-rigid, but flexible support structure. Reference numeral 929 indicates the arch-forefoot transitional portion of the semi-rigid material 920. The semi-rigid material 920 narrows as it moves toward the heel and away from the front outsole 972. This smoothes the transition from one structural support material, the EVA forefoot outsole portion 972 into another, the semi-rigid material 920, to mitigate wrinkling, puckering and bunching of surrounding materials. The forefoot portion of the semi-rigid material 920 continues through the arch section 940 and ends at flexible rear stretch panel 991, which separates it from the heel portion of the semi-rigid material 920.

The stretch panel 991 is free of any coverings or other materials of the shoe upper 901 or outsole overlying it and can be made of a variety of stretch materials, for example such as Lycra, mesh, neoprene, stretch leather, stretch canvas, spandex, stretch PU etc. The stretch panel 991 serves to mitigate relative longitudinal movement of the shoe material compared to the foot when the foot is in motion, bending and flexing. Rather than the material seemingly travelling forwards and backwards to the heel and toe sections, the relative movement is at least partially absorbed through the stretch panel 991. The stretch panel 991 also acts as a size leeway, allowing the wearer a more custom fit.

When a dancer is standing flat in a neutral position, the stretch panel is extended. When the dancer's foot is in pointe position the stretch panel 991 is allowed to contract fully or partially. The presence of a semi-rigid material 920 encasing the heel and supporting the arch increases support levels for the foot and ankle, and offers controlled resistance.

The stretch panel 991 is shaped and located so as to be widest where it underlies the foot and effectively forms part of the outsole in a transition region between the arch section 940 and the heel section 910. Stretch panel 991 generally resembles a U-shape when flattened or viewed from each end of the shoe 900, extending around and up from the outsole region on each lateral side of the shoe 900, narrowing gradually in width and curving in a rearward sweep until it terminates at the binding 902 near upper heel portion 922 of semi-rigid material 920. As the greatest amount of expansion or contraction of the stretch panel occurs in the outsole region, the stretch panel 991 can be narrower and afford less expansion/contraction as it extends toward the binding 902. Stretch panel 991 is stitched to adjacent parts of upper 901 and outsole portions, including adjacent rear and forward locations of semi-rigid material 920 (at arch portion 940 and heel portion 910) and optionally also a forwardly located backstrap 932.

The heel portion of the semi-rigid material 920 encasing or cupping the heel section 910 is still present but is separated from a front section of semi-rigid material 920 by the back stretch panel 991. The heel portion of the semi-rigid material 920 serves to increase support for the heel and ankle and ensure a clean smooth material line around the heel. These divided semi-rigid material sections 920 provide a reinforcing structure for the shoe 900 to increase support levels for the foot and ankle, and offer controlled resistance to foot flexion.

Figures 9A, 9B, 9C, 9D:
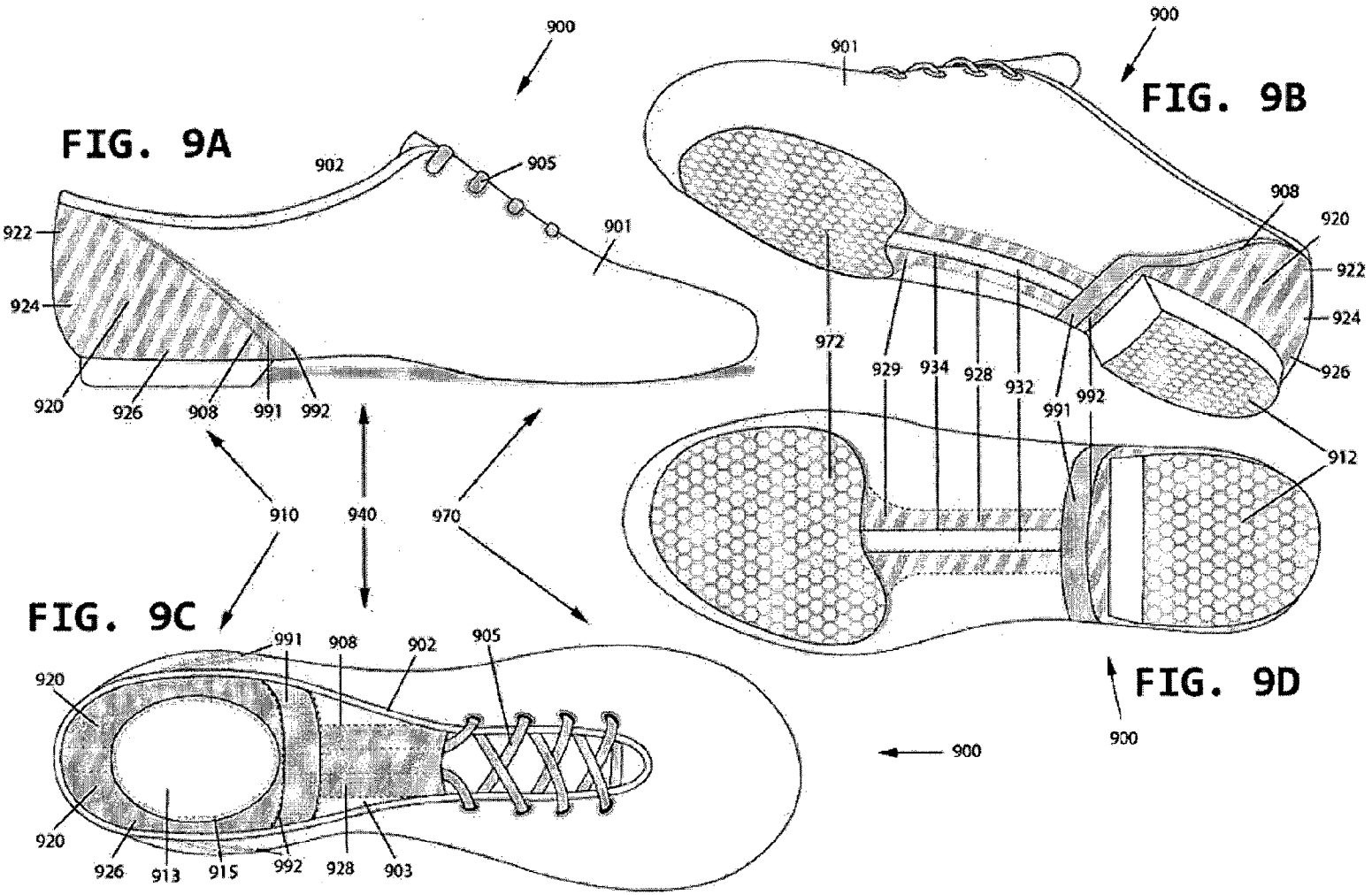
FIG. 9A shows a side view of the split sole jazz shoe according to some embodiments.
FIG. 9B shows a bottom perspective view of the split sole jazz shoe of FIG. 9A.
FIG. 9C shows a top view of the split sole jazz shoe of FIG. 9A.
FIG. 9D shows a bottom view of the split sole jazz shoe of FIG. 9A.

The semi-rigid material 920 is attached to the upper 901 and lining 903. The semi-rigid material 920 can be attached on the inside of the shoe, on top of the lining 903 as shown in FIG. 9C or in between the lining 903 and the upper 901. The semi-rigid material 920 can alternatively be attached on the outside of the shoe, outside of the upper 901 in full view. The stretch panel 991 is sewn to the upper 901 and lining 903 by stitching 992. The lining 903 is layered into the upper 901. The backstrap 932 is attached to the upper 901 and the sole of shoe 900 by stitching 934. The rear outsole portion 912 and front outsole portion 972 may be glued to the upper 901.

The stretch panel 481, 691, 881, 991 can be made up of a variety of stretch materials, for example Lycra, mesh, neoprene, stretch leather, stretch canvas, spandex, stretch PU etc. The material of the stretch panel of some embodiments is neoprene. When the shoe is off the foot, the neoprene is in a relaxed contracted state, at rest. When the shoe is placed on the foot, depending on the foot length, the neoprene is elastically lengthened (stretched). The direction of the stretch is longitudinal, making an allowance for different length feet. When the foot is placed flat on the floor, or when the dancer performs a "demi plie" movement, the foot is at its longest. In this instance, the stretch panel can be stretched in the longitudinal direction of the shoe by up to 150%. For example, a neoprene stretch panel of 6 mm relaxed, can stretch to up to 15 mm. This is a difference of 9 mm which translates to roughly two whole shoe sizes.

The stretch panel does not affect the width fittings of the shoe. However as the sizes increase, so does the width of the shoe, incrementally, and there is a proportional increase in the width (in the longitudinal direction of the shoe) of the stretch panel. The shoe may therefore be fitted for correct width, and the stretch panel may accommodate inaccuracies in length.

The semi-rigid material 720, 820, 920 and 1120 (FIGS. 11A to 11D) forms a larger cup around the heel on the jazz shoe embodiments because a shoe with a heel (in this case a 10 mm high heel) requires more ankle support than a shoe with no heel such as a ballet slipper. Jazz shoes (and other shoes with heels that raise the upper off the floor) may contain a "heel counter" which prevents the heel area from collapsing after a time of wear. The semi-rigid material in this example works in conjunction with the heel counter to provide additional cushioning and is basically mimicking the line of the heel counter. This is for neatness and ease of manufacturing, as well as increasing the rigidity around the ankle and increasing ankle arch support. The semi-rigid material 720, 820, 920, 1120 in the heel of the jazz shoe performs primarily cushioning functions, as it is much less rigid than a heel counter, but its extension as one piece (or two separate pieces for semi-rigid materials 920, 1120) through the arch is believed to have benefits in mitigating wrinkling or bunching of the shoe upper and portions of the outsole.

As shown in FIG. 3, a ballet shoe 300 according to some embodiments may employ a larger (wider) upper heel portion 322 of semi-rigid material 320 around the heel section, somewhat similar to the size of the semi-rigid material 720, 820, 920 for jazz shoe 700, 800, 900. Upper heel portion 322 is sufficiently wide to extend some distance around each lateral side of the ballet shoe 300 adjacent the binding to an area of the foot corresponding to the vertical line of the fibula, the posterior talofibular ligament and/or the calcaneofibular ligament. In contrast, other ballet shoe embodiments described herein employ a semi-rigid material 220, 420, 620 that at the upper heel portion 222, 422, 622 slightly cups the Achilles tendon or upper posterior part of the calcaneus without extending as far as the vertical line of the fibula, the posterior talofibular ligament and/or the calcaneofibular ligament.

FIG. 3 depicts a ballet shoe 300 similar to ballet shoes 200, 400 and 600, but with a much wider semi-rigid material around the heel section 310 to match the jazz shoe heel size. A firmer and more enveloping cupping of the heel by the semi-rigid material 320 occurs in the heel section 310, but the semi-rigid material 320 still reduces substantially in width as it reaches the heel-arch transition 327 and passes into the arch. Such designs may provide increased heel and ankle support, but may provide more resistance to foot flexion.

Like the other ballet shoe embodiments shown and described, ballet shoe 300 optionally has a heel backstrap 332 stitched to an upper 301 and the semi-rigid material 320 as it extends from the binding at the back of the heel, down around the base of the heel and through the arch. Semi-rigid material 320 is attached to the lining and shoe upper 301 by stitching 308 and to the heel outsole and insole portions by stitching in the same manner as shown in the other ballet shoe embodiments. Arch section 340 and forefoot section 370 are substantially the same for shoe 300 as for shoes 200, 400 and 600.

Referring also to FIGS. 10A, 10B and 10C, embodiments of a full sole ballet slipper 1000 are described and shown in further detail. The slipper 1000 is similar to slipper 200, in that it has a semi-rigid material 1020 extending from an upper heel portion adjacent the binding down over the mid-heel and around a lower posterior portion of the calcaneus through to where the heel transitions to the arch of the foot. Shoe 1000 differs from shoe 200, however, in that a full outsole 1060, which may be formed of a single piece of suede or light canvas, for example, is provided instead of the split sole arrangement of shoe 200.

A backstrap 1032 may optionally be provided, running from adjacent the binding down around the heel along a longitudinal center-line of the shoe 1000. Similarly, semi-rigid material 1020 is attached to the shoe upper and lining by stitching 1008. In such embodiments, the semi-rigid material 1020 forms part of a reinforcing structure in the heel section of the shoe 1000, with the outsole 1060 providing a reinforcing structure bridging the heel and arch sections. Thus, the semi-rigid material 1020 may extend laterally around the heel in a cupping manner, broadening from the upper heel portion adjacent the binding as it progresses down around a lower posterior portion of the calcaneus, then narrowing toward a heel-arch transition region. Such embodiments may advantageously provide increased support around the heel section of the shoe.

Outsole 1060 may be formed as one piece of material or more than one piece, having a rounded section underlying at least part of the heel, then tapering inwardly as it progresses through the arch section and then widening to a larger rounded area to underlie the forefoot section. This arrangement of outsole 1060 is most visible in FIG. 10B. Outsoles 1060 may be stitched to the shoe upper by suitable stitching around an edge of the outsole piece or pieces and may be complemented by heel and forefoot insole portions positioned inside the shoe.

A ballet shoe or jazz shoe according to some further embodiments may employ a smaller (narrower) semi-rigid material through the heel section or arch section than is described above. In such embodiments, the cupping of the heel by the semi-rigid material is less and the support provided by the semi-rigid material as it passes into the arch is reduced relative to the embodiments described above that employ the wider semi-rigid material.

For ballet shoe embodiments, the thickness of the shoe upper and lining together may be around 1 mm to around 4 mm, not including outsole portions or the semi-rigid material. The maximum thickness of ballet shoe embodiments, for example including insole, lining, semi-rigid material, outer material (which may effectively be part of the upper) and outsole portion, preferably does not exceed about 8-10 mm and is preferably less than about 6 mm.

Described embodiments relating to a semi-rigid material in the arch section 240, 440, 640 are generally not applicable to ballet pointe shoes because of the much greater rigidity required of the sole structure of pointe shoes. However the presence of a semi-rigid material in the heel section of a pointe shoe in relation to the rigid sole structure of a pointe shoe is relevant in minimising creasing, bunching and puckering of the upper materials and its linings.

Referring now to FIGS. 11A, 11B, 11C and 11D, a split-sole dance shoe 1100 according to further embodiments is shown and described. Shoe 1100 is the same as shoe 200, except that it additionally includes a small, thin, elongate flexible board 1180 extending through the arch section 1140 and marginally into the heel and forefoot sections 1110, 1170, without extending through those sections. The purpose of the board 1180 is to provide a supplement to the reinforcing structure provided by the semi-rigid material 1120 through the arch section 1140, providing greater resistance to flexion of the foot. Such increase in resistance of flexion through the arch is not intended to be more than about an order of magnitude greater than the resistance already provided by the semi-rigid material 1120.

Flexible board 1180 may have a lateral width roughly the same as, or within about 20% of, the width of the semi-rigid material 1120 through the arch section 1140. The flexible board 1180 may be positioned along a longitudinal direction, such as a centre line, of the shoe 1100 or slightly offset therefrom.

Board 1180 may comprise a pulp board material, such as is commonly referred to as a "texon board", such as is made by Texon International, or a similar board material. The thickness of the board 1180 may be around 0.5 mm to around 0.8 mm, optionally around 0.6 mm. Board 1180 may be generally rectangular or slightly trapezoidal or with slightly curved or flared ends.

Figure 11D:
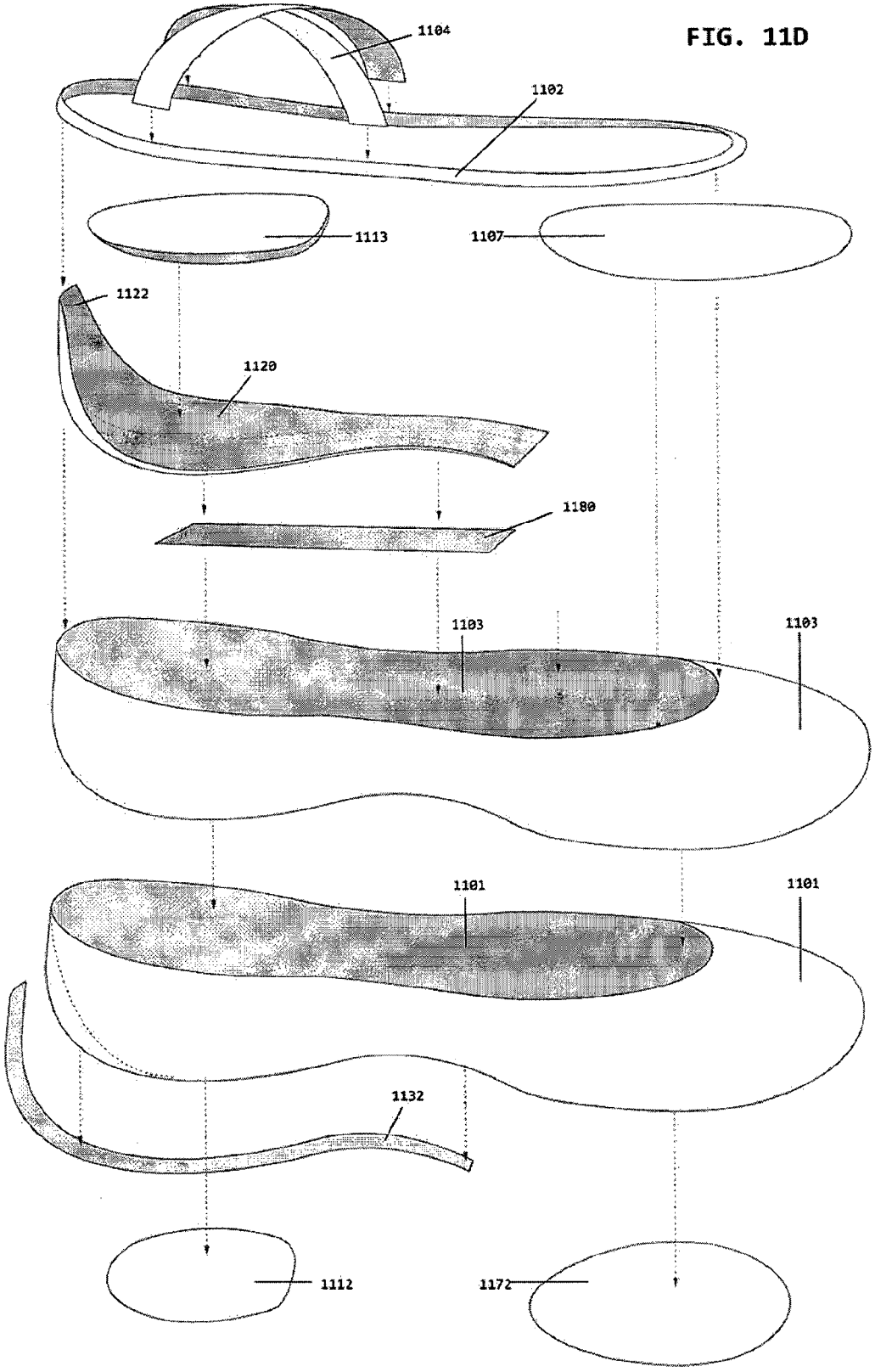
FIG. 11D is an exploded perspective view of the split sole ballet shoe of FIG. 11A, showing component parts thereof.

As is illustrated in FIG. 11D, board 1180 may be positioned as an insert inside the shoe and stitched or adhered between semi-rigid material 1120 and a lining 1103. Alternatively, board 1180 may be stitched or adhered to one or both of lining 1103 and outsole 1101 and sandwiched therebetween. As is illustrated in FIG. 11D, shoe 1100 is similar to other ballet shoe embodiments, in that it has one or more straps 1104, a binding 1102, forefoot and heel insole portions 1107, 1113, a backstrap 1132 and heel and forefoot outsole portions 1112 and 1172, all of which are stitched and/or adhered to adjacent components in the manner shown. Semi-rigid material 1120 is the same as semi-rigid material 220, or alternatively is the same as semi-rigid material 320, in terms of its proportions, positioning, configuration and material characteristics, as previously described.

Figure 12A:
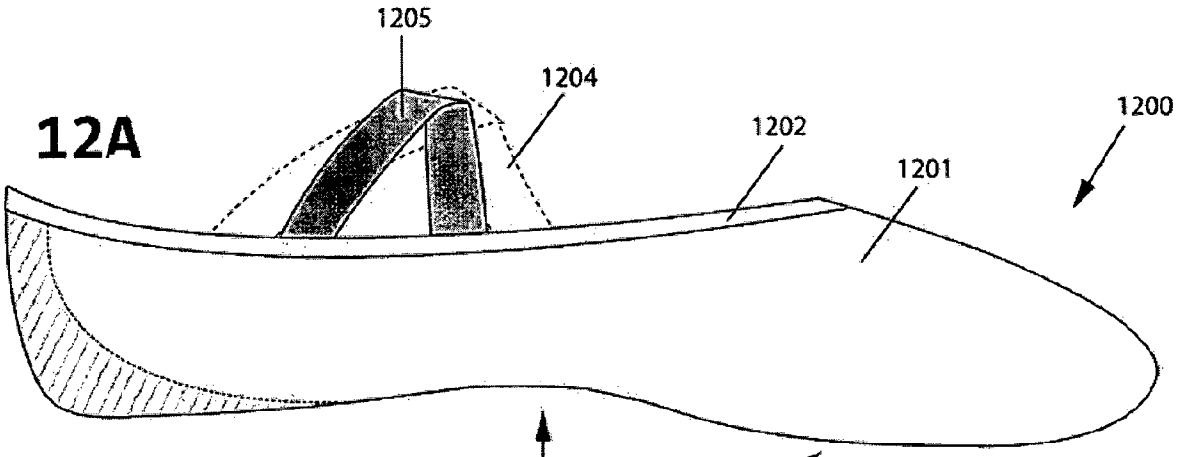
FIG. 12A is a side view of a ballet shoe according to further embodiments, showing modified strap positioning.
Figure 12B:
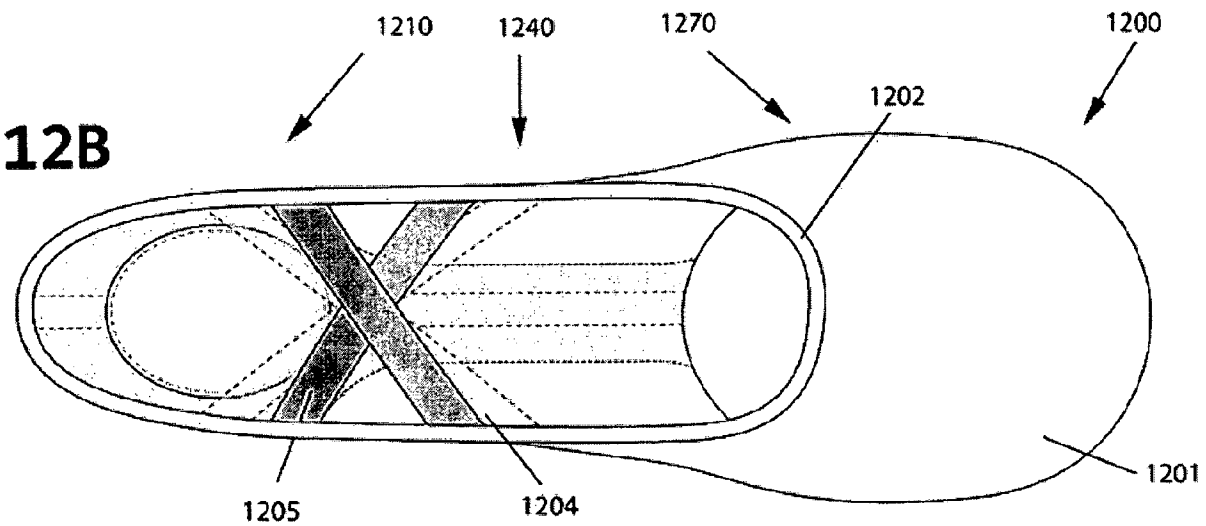
FIG. 12B is a plan view of the ballet shoe of FIG. 12A.

Referring now to FIGS. 12A and 12B, a split-sole ballet shoe 1200 is shown, having a strap arrangement in which straps 1205 are connected more longitudinally closely to each other on each lateral side of the opening and at a shallow acute angle (e.g. 5 to 30 degrees or so) relative to each other in the lateral direction. For reference purposes only, the relative spacing of connection points of straps 1204 is illustrated by dashed lines. The smaller longitudinal separation of the connection points of straps 1205 to the edges of the shoe upper 1201 at binding 1202 serves to direct more tension exerted by straps 1205 (when worn) through the arch section 1240, while directing significantly less tension through the heel section 1210 than with the more longitudinally spread arrangement of straps 1204. Thus, straps 1205 are intended to primarily direct tension through the arch section 1240 with minimal or no tension directed through the heel section 1210. It is recognized, however, that it is difficult to eliminate tension directed through the heel section 1210 but if the tension is directed instead toward a transition region between the heel section 1210 and the arch section 1240, this involves relatively minimal tension being applied to the heel section 1210. The configuration of straps 1205 is thus desired to induce tension that is insufficient through the heel section 1210 to prevent the back of the shoe 1200 adjacent the heel from becoming slightly spaced from the dancer's heel when the foot is in pointe position. The allowing of this slight spacing of the back of the shoe 1200 from the dancer's heel means that the line of the shoe through the arch section 1240 stays clean and aesthetically appealing as the foot is flexed in pointe position.

Figure 13A:
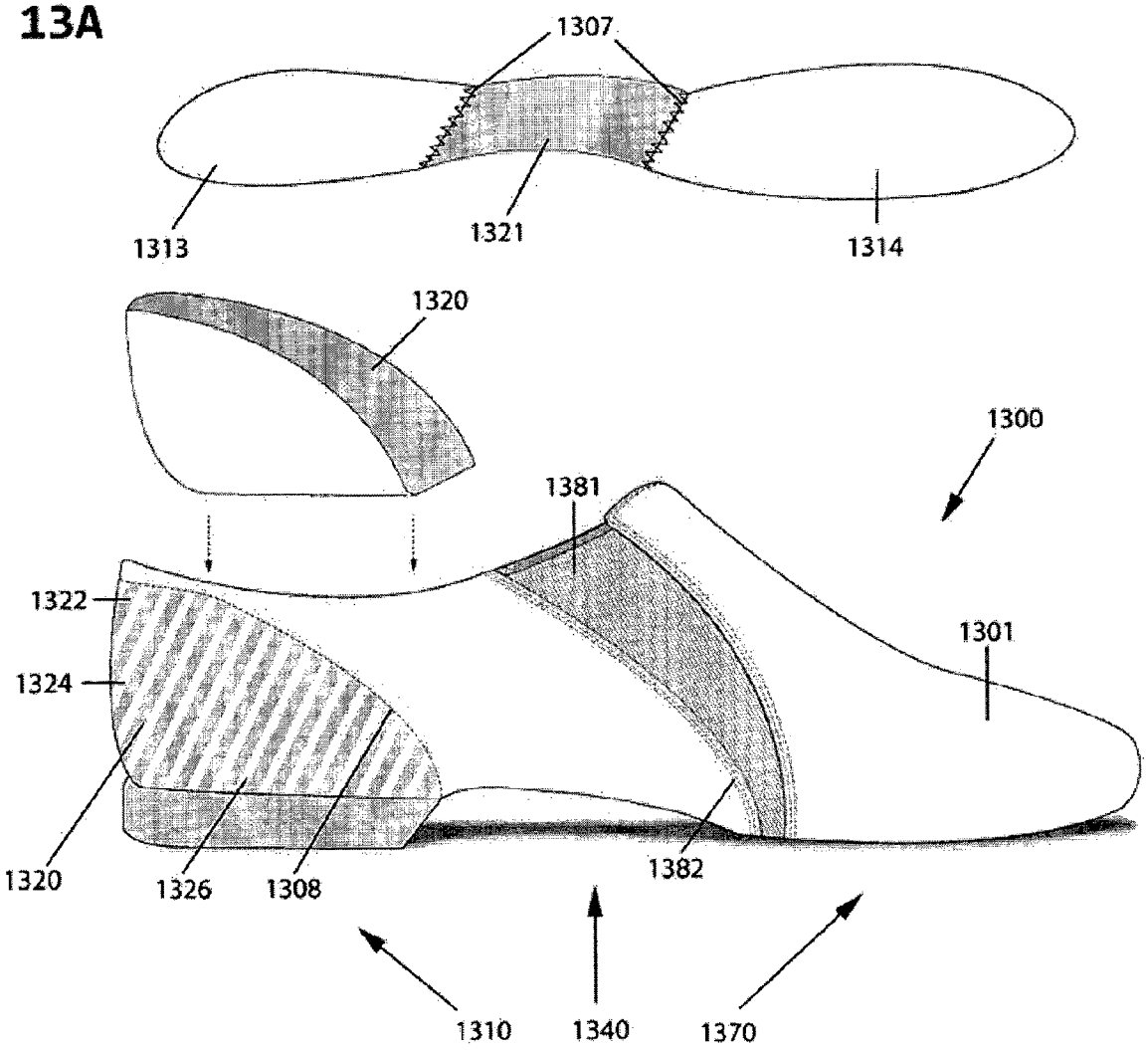
FIG. 13A is an exploded perspective view of a jazz shoe according to further embodiments.
Figures 13B, 13C:
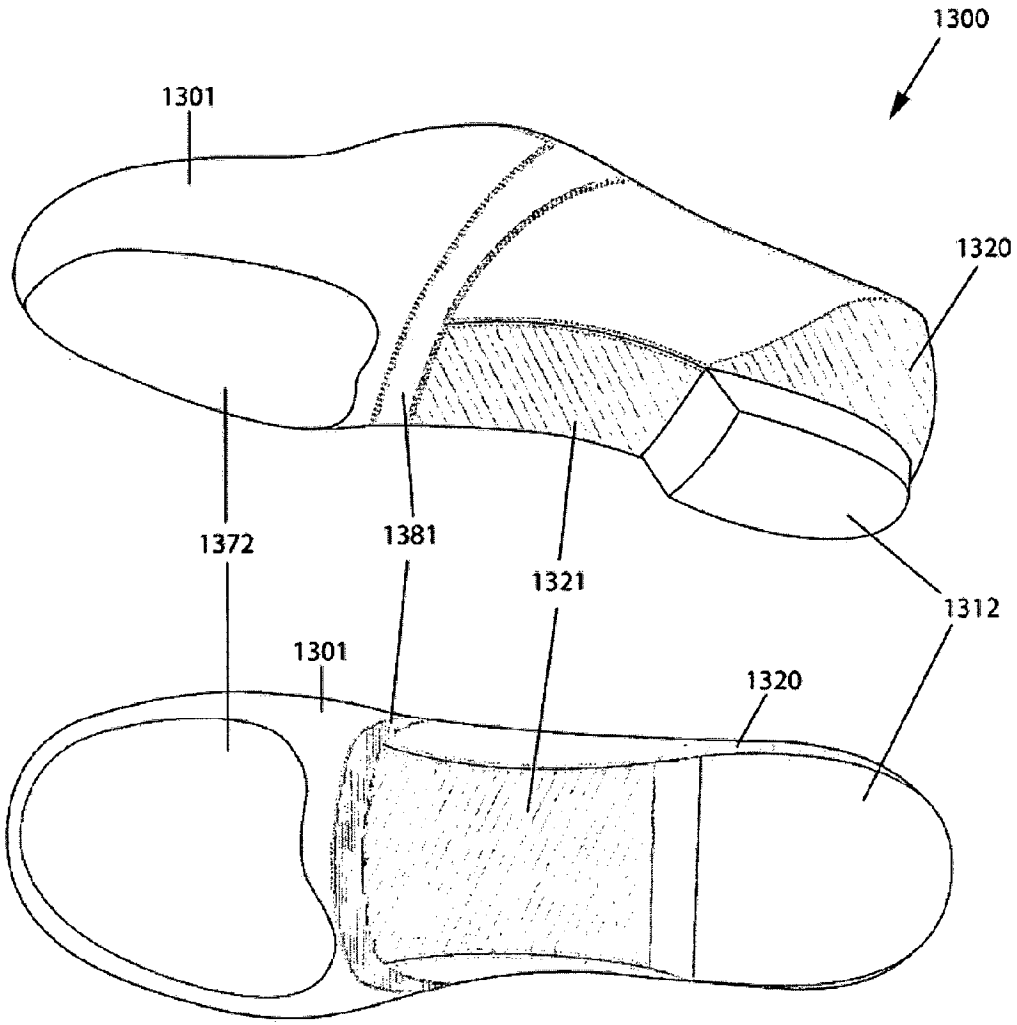
FIG. 13B is a bottom perspective view of the jazz shoe of FIG. 13A.
FIG. 13C is a bottom view of the jazz shoe of FIG. 13A.

Referring now to FIGS. 13A, 13B and 13C, embodiments of a split-sole jazz shoe 1300 are shown and described in further detail. FIG. 13A illustrates an exploded view of the shoe 1300, showing a semi-rigid material 1320 positioned in the heel section 1310 to substantially coincide with a heel counter stitched and/or adhered into the heel of the shoe 1300. Jazz shoe 1300 is similar to shoe 800, except the semi-rigid material is provided in two sections 1320, 1321 in shoe 1300. Thus, semi-rigid material 1320 provided in the heel section 1310 represents a first thin flexible reinforcing structure, while a flat strip of the same or a similar semi-rigid material 1321 provides a second thin flexible reinforcing structure to extend across the arch section 1340. This strip of semi-rigid material 1321 may be attached to sole and forefoot insert portions 1313 and 1314 to form an insert to be adhered and/or stitched to the inside of the outsole of shoe 1300.

Like shoe 800, shoe 1300 has a stretch panel 1381 but, because shoe 1300 does not have laces, the stretch panel 1381 is designed to expand slightly to accommodate an insertion of the foot and retention of the shoe 1300 on the foot at least in part because of tension induced by expansion of the stretch panel 1381 when worn on the dancer's foot.

The semi-rigid material 1320 extending across the arch section 1340 may be substantially wider than the semi-rigid material extending across the arch section in the other jazz shoe embodiments and may, for example, extend across substantially the whole lateral width of the arch section of the arch sole. In embodiments corresponding to shoe 1300, semi-rigid materials 1320, 1321 may not be directly attached to each other, but they nevertheless combine to provide a desirable amount of soft flexible reinforcing structure to a shoe that would otherwise only have a heel counter, the outsole material and the lining material to act as support for the dancer's foot.

In the depicted embodiments of shoe 1300, semi-rigid material 1321 extends longitudinally from roughly the heel-arch transition region to the bottom of the U-shaped stretch panel 1381 separating the arch section 1340 from the forefoot section 1370. Thus, a semi-rigid material 1321 does not extend through to the forefoot section 1370, instead terminating at the forward located stretch panel 1381.

Various embodiments have been described herein, in combination with various different configurations, arrangements, features and functions of the depicted dance shoes. The embodiments are intended to cover various combinations of such features, functions, configurations and depicted arrangements, as may be appropriate for the type of dance shoe in question. For example, while FIG. 10A shows a ballet shoe with only a single strap, it should be understood that other ballet shoe embodiments described herein may have only a single strap. Equally, the arrangement of straps 1205 having a longitudinally shortened spacing between their connection points to the shoe upper and having a position generally coinciding with the arch section and/or heel-arch transition region may be applied to the other ballet shoe embodiments described herein. Additionally, while exploded diagrams have been provided to illustrate construction of some of the shoes described herein, this is provided by way of example and without limitation, as an illustrative guide to construction of the embodiments.

The semi-rigid materials used in the heel sections described herein are intended to be differentiated from a normal heel counter by being more flexible, softer and having lower density, thereby readily allowing flexion of the foot without uncomfortably impinging on the skin or structures of the foot around the heel or arch.

While embodiments are described herein in specific detail, it is to be understood that such embodiments are described by way of example and are not to be construed to be limiting with respect to equivalents or to limit the scope of the invention.

Throughout this specification and claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. A split-sole dance shoe, comprising:

a thin flexible shoe upper defining an opening to receive a foot;

an outsole region to underlie a sole of the foot and in combination with the upper defining a heel section, an arch section and a forefoot section, the outsole region comprising a split outsole in two parts, wherein the heel section comprises a first outsole part and the forefoot section comprises a second outsole part; and thin flexible reinforcing structure coupled to the shoe upper and the outsole region and extending from adjacent the opening in an upper part of the heel section around a lower part of the heel section and through the arch section along a longitudinal direction of the shoe, the reinforcing structure broadening from adjacent the opening to substantially cup a lower posterior portion of the calcaneus when the shoe is worn on the foot and then narrowing toward the arch section, the reinforcing structure in the arch section being formed to closely match flexion of an arch of the foot when the shoe is worn on the foot and the foot is in pointe position without the appearance of bunching of the shoe upper in the arch section.

2. The split-sole dance shoe of claim 1, wherein the reinforcing structure extends through the arch section but does not extend through the forefoot section.

3. The split-sole dance shoe of claim 1, wherein the reinforcing structure comprises a semi-rigid material.

4. The split-sole dance shoe of claim 3, wherein the outsole region has a heel outsole portion and a forefoot outsole portion, and wherein the semi-rigid material extends through the arch section and terminates adjacent the forefoot outsole portion.

5. The split-sole dance shoe of claim 3, wherein the semi-rigid material has a slightly narrowing or substantially constant width as it extends across the arch section.

6. The split-sole dance shoe of claim 1, further comprising a backstrap affixed to the shoe upper and extending along a longitudinal center-line of the shoe from the upper part of the heel section to the forefoot section, the backstrap coinciding with a central longitudinal seam extending through the outsole to the forefoot section.

7. The split-sole dance shoe of claim 1, further comprising an elastic panel extending from adjacent the opening on one lateral side of the shoe down through the outsole region and around up to adjacent the opening on an opposite lateral side of the shoe.

8. The split-sole dance shoe of claim 7, wherein the elastic panel is free of covering fabric.

9. The split-sole dance shoe of claim 7, wherein the elastic panel interrupts the shoe upper and the outsole.

10. The split-sole dance shoe of claim 7, wherein the elastic panel allows the shoe to accommodate feet of longer lengths than would be accommodated without the elastic panel.

11. The split-sole dance shoe of claim 7, wherein the elastic panel is positioned so that it extends through the outsole at or adjacent a transition from the heel section to the arch section.

12. The split-sole dance shoe of claim 7, wherein the elastic panel is positioned so that it extends through the outsole at or adjacent a transition from the arch section to the forefoot section.

13. The split-sole dance shoe of claim 12, wherein the elastic panel is curved in a rearward sweep as it extends through each lateral side of the shoe.

14. The split-sole dance shoe of claim 1, wherein the reinforcing structure has a thickness of about 2 mm to about 4 mm.

15. The split-shoe dance shoe of claim 14, wherein the reinforcing structure further comprises a thin flexible board material.

16. The split-sole dance shoe of claim 1, wherein the reinforcing structure comprises a foam material.

17. The split-sole dance shoe of claim 16, wherein the foam material comprises ethylene vinyl acetate (EVA) foam.

18. The split-sole dance shoe of claim 17, wherein the foam material consists essentially of EVA foam and rubber.

19. The split-sole dance shoe of claim 18, wherein the foam material comprises about 40% to 60% by weight of EVA foam, about 40% to 60% by weight of rubber and 0% to 20% of other material.

20. The split-sole dance shoe of claim 18, wherein the rubber is synthetic rubber.

21. The split-sole dance shoe of claim 1, wherein the reinforcing structure provides support to the arch of the foot when the shoe is worn on the foot.

22. The split-sole dance shoe of claim 1, wherein the reinforcing structure comprises a material selected from the group consisting of: non-woven bonded synthetic fibrous materials; counter materials; fiber boards; sponge rubber; natural rubber; neoprene; styrene-butadiene rubber (SBR);

butyl rubber; silicone rubber; nitrile rubber; urethane rubber; polyurethane foam; cork; cellulosic materials; ethylene vinyl acetate (EVA) foam; polyethylene foam; cross-linked polyethylene foam; high density micro-cellular foam; and closed cell polyvinyl chloride foam.

23. The split-sole dance shoe of claim 1, wherein the reinforcing structure has a density of about 30 $kg/m^3$ to about 120 $kg/m^3$.

24. The split-sole dance shoe of claim 1, wherein the shoe is a ballet shoe.

25. The split-sole dance shoe of claim 24, further comprising at least one elastic strap coupled to the shoe upper and extending across the opening, the at least one strap being arranged to overlie tarsal bones of the foot when the shoe is worn and to apply tension primarily to the arch section and minimal or no tension to the heel section.

26. The split-sole dance shoe of claim 25, wherein tension applied to the heel section by the at least one strap is insufficient to prevent separation between the calcaneus and a rear wall of the heel section in pointe position.

27. The split-sole dance shoe of claim 1, wherein the shoe is one of a jazz shoe, tap shoe, a dance sneaker and a modern dance shoe.

* * * * *